US006252340B1

(12) United States Patent
Hattori

(10) Patent No.: US 6,252,340 B1
(45) Date of Patent: Jun. 26, 2001

(54) FIELD EMISSION ELEMENT WITH ANTIREFLECTION FILM

(75) Inventor: Atsuo Hattori, Hamamatsu (JP)

(73) Assignee: Yamaha Corporation, Tokyo (JP)

( * ) Notice: Subject to any disclaimer, the term of this patent is extended or adjusted under 35 U.S.C. 154(b) by 0 days.

(21) Appl. No.: 09/335,984

(22) Filed: Jun. 18, 1999

(30) Foreign Application Priority Data

Jun. 22, 1998 (JP) ..... 10-175195

(51) Int. Cl.[7] ..... H01J 1/304; H01J 19/24

(52) U.S. Cl. ..... 313/336; 313/495; 313/309; 313/351

(58) Field of Search ..... 313/336, 495, 313/309, 351; 445/24, 50

(56) References Cited

U.S. PATENT DOCUMENTS 5,599,749 2/1997 Hattori ..... 437/228
5,795,208 8/1998 Hattori ..... 445/50
6,074,264 * 6/2000 Hattori ..... 445/24

* cited by examiner

*Primary Examiner*—Vip Patel
*Assistant Examiner*—Ken A Berck
(74) *Attorney, Agent, or Firm*—Ostrolenk, Faber, Gerb & Soffen, LLP

(57) ABSTRACT

A method of manufacturing a field emission element including the steps of: forming a conductive film on an antireflection film; forming a resist pattern on the antireflection film through photolithography; forming holes through the antireflection film and conductive film by using the resist pattern as a mask; removing the resist pattern, depositing a first sacrificial film over a substrate and etching back the first sacrificial film to leave a side spacer on an inner wall of the hole of the conductive film; depositing a second sacrificial film over the substrate and forming a conductive emitter electrode on the second sacrificial film; and partially removing the second sacrificial film to expose a tip portion of the emitter electrode. This method can form a gate hole at a high precision in size.

16 Claims, 31 Drawing Sheets

FIELD EMISSION ELEMENT WITH ANTIREFLECTION FILM

This application is based on Japanese patent application No. HEI 10-175195 filed on Jun. 22, 1998, all the contents of which are incorporated herein by reference.

BACKGROUND OF THE INVENTION a) Field of the Invention

The present invention relates to a field emission element with antireflection film and a method of manufacturing a field emission element, and more particularly to a field emission element with a having a field emission cathode tip from which electrons are emitted, and a method of manufacturing a field emission element.

b) Description of the Related Art

A field emission element emits electrons from a sharp tip of an emitter (field emission cathode) by utilizing electric field concentration. For example, a flat panel display can be structured by using a field emitter array (FEA) having a number of emitters disposed in array. Each emitter controls the luminance of a corresponding pixel of the display.

FIGS. 16A to 16F illustrate a conventional manufacture method of a field emission element.

As shown in FIG. 16A, a conductive gate electrode film 62 is formed on a substrate 61, and a resist pattern 63 having a predetermined shape is formed on the gate electrode film 62 through photolithography.

Next, by using the resist pattern 63 as a mask, the gate electrode film 62 is anisotropically etched to leave a gate electrode 62*a* with a gate hole 67 having a circular plan shape (as viewed from the upper shape), as shown in FIG. 16B. This etching reduces the thickness of the resist pattern 63 so that a thin resist pattern 63*a* is left.

Next, as shown in FIG. 16C, after the resist pattern 63*a* is removed, a sacrificial film 64 is isotropically deposited on the surface of the gate electrode 62*a* and on the exposed surface of the substrate 61.

Next, as shown in FIG. 16D, the sacrificial film 64 is anisotropically etched to leave a sacrificial film (side spacer) 64*a* on the inner wall of the hole 67 of the gate electrode 62*a,* the sacrificial film 64*a* reducing its opening diameter toward the substrate.

Next, as shown in FIG. 16E, an insulating film 65 is deposited on the whole substrate surface, and a conductive emitter electrode 66 is formed on the insulating film 65.

Next, as shown in FIG. 16F, the whole of the substrate 61 and side spacer 64*a* and part of the insulating film 65 are etched and removed, leaving a peripheral insulating film 65*a* between the gate electrode 62*a* and emitter electrode 66.

As a positive potential is applied to the gate electrode 62*a,* an electric field can be concentrated upon the tip of the emitter electrode (cathode) 66 so that electrons are emitted from the emitter electrode 66 toward an anode electrode (not shown).

The gate electrode 62*a* surrounds the gate hole 67 and is made of two parts (laterally separated regions) as viewed in section. A distance between these two parts in the horizontal direction is called a gate diameter. A voltage to be applied to the gate electrode 62*a* is determined by the gate diameter.

The resist pattern 63 having a predetermined shape shown in FIG. 16A is formed through photolithography. First, a resist film (photosensitive resin) is formed on the whole surface of the gate electrode film 62, and thereafter exposed and developed to form the resist pattern 63 having a predetermined shape.

It is not preferable if during the exposure, an amount of light reflected from the gate electrode film 62 under the resist film 63 is large. The gate electrode film 62 is made of metal or semiconductor having a low resistivity. However, metal and semiconductor has generally a large reflectance.

During the exposure, light passes through the resist film 63 and is reflected by the gate electrode film 62 so that an area not desired is also exposed. This reflected light becomes more influential particularly when the surface of the gate electrode film 62 has steps. In such a case, the resist pattern 63 after the development cannot have a desired shape. Therefore, if this resist pattern 63 is used as a mask and the etching process illustrated in FIG. 16B is performed, the gate electrode 62*a* having a desired pattern cannot be formed.

If the resist film 63 is a positive resist film, the gate electrode 62*a* is likely to have a compression or a disconnection, whereas if the resist film 63 is a negative resist film, the gate electrode 62*a* is likely to have a projection or a bridge.

The following problems also occur.

(1) Multiple interferences during exposure change with a thickness of the resist film 63 so that the sizes of gate electrodes have a variation.

(2) If there is a reflectance variation in gate electrode films 62, the sizes of gate electrodes have a variation.

(3) Since a standing wave is generated in the resist film 63, a resolution of the resist film 63 lowers.

(4) It is necessary to use a thick resist film 63 because an etching selection ratio of the resist film 63*a* to the gate electrode film 62*a* during the etching process (FIG. 16B) is low. For example, if the gate electrode film 62 has a thickness of 0.3 $\mu$m, it is necessary to use the resist film 63 having a thickness of 0.8 $\mu$m or more. If the resist film 63 is thick, the microloading effects become conspicuous and an etching precision, an etching uniformity, an etching throughput and an etched cross section are degraded.

From the above reasons, it is difficult to highly precisely form a gate electrode having a predetermined shape, and the precision of a gate diameter of the gate hole of the gate electrode 62*a* lowers. In a flat panel display having a number of field emission elements, a variation in gate diameters makes the characteristics of each field emission element different. Namely, the luminance of pixels of the display become irregular.

SUMMARY OF THE INVENTION

It is an object of the present invention to provide a manufacture method for a field emission element having a high precision of size.

It is another object of the present invention to provide a manufacture method for a field emission element with a gate hole having a high precision of size.

According to one aspect of the present invention, there is provided a field emission element comprising: a gate electrode having a first opening; an antireflection film formed on the gate electrode, the antireflection film having a second opening and a refractive index smaller than a refractive index of the gate electrode; an insulating film formed on the antireflection film, the insulating film having a third opening; and an emitter electrode formed on the insulating film, wherein the emitter electrode includes a peripheral portion supported on the insulating film and a projecting portion rising from the peripheral portion and projecting in the first to third openings, and the projecting portion includes a base portion being continuous with the peripheral portion and having at least an outer surface with a radius of curvature and a tip portion having a sharp cusp and an outer surface with a radius of curvature smaller than the radius of curvature of the outer surface of the base portion.

According to another aspect of the present invention, there is provided a field emission element comprising: a starting substrate; an anode electrode film formed on the starting substrate; a first sacrificial film formed on the anode electrode film and having a first opening; a gate electrode formed on the first sacrificial film and having a second opening; an antireflection film formed on the gate electrode and having a third opening; an insulating film formed on the antireflection film and having a fourth opening; and an emitter electrode formed on the insulating film and having a fifth opening, wherein the emitter electrode includes a peripheral portion supported on the insulating film and a projecting portion rising from the peripheral portion and projecting into the second to fourth openings, and the projecting portion includes a base portion being continuous with the peripheral portion and having at least an outer surface with a radius of curvature and a tip portion having a sharp cusp and an outer surface with a radius of curvature smaller than the radius of curvature of the outer surface the base portion.

According to another aspect of the present invention, there is provided a method of manufacturing a field emission element comprising the steps of: (a) forming a conductive film on a surface of a substrate, the conductive film including at least one layer or more; (b) forming an antireflection film on the conductive film; (c) forming a resist pattern on the antireflection film through photolithography; (d) forming a hole through the antireflection film through etching using the resist pattern, the hole reaching at least a surface of the conductive film; (e) forming a hole thorough the conductive film through etching using one of the resist pattern and the antireflection film as a mask, the hole reaching at least the surface of the substrate; (f) removing the resist pattern before or after the step (e); (g) forming a first sacrificial film over the substrate, the first sacrificial film covering the conductive film; (h) etching back the first sacrificial film to leave a side spacer on an inner wall of the hole of the conductive film and/or the hole of the antireflection film; (i) forming a second sacrificial film over the substrate, the second sacrificial film covering the side spacer; (j) forming a conductive emitter film on the second sacrificial film; and (k) exposing a tip portion of the emitter film at least near at the holes by removing at least a portion of the second sacrificial film.

The antireflection film reduces light reflection during exposure. If a resist film is formed directly on the conductive film, reflected light increases so that a resist pattern cannot be formed at a high resolution through photolithography. If a resist film is formed on an antireflection film, reflected light reduces so that a resist pattern can be formed at a high resolution through photolithography. Therefore, the shape and size of an emitter electrode can be controlled at a high precision.

The conductive film can be used as a gate electrode. In this case, the shape and size of the gate electrode can be controlled at a high precision and a precision of the gate hole diameter can be improved. A variation of gate hole diameters of a flat display panel having a number of field emission elements can be reduced so that the electric characteristics of field emission elements can be made uniform and so the luminance of pixels of the display can be made uniform.

As described above, a resist pattern can be formed at a high resolution on an antireflection film. It is therefore possible to control the shape and size of an emitter electrode at a high precision.

The conductive film can be used as a gate electrode. In this case, the shape and size of the gate electrode can be controlled at a high precision and a precision of the gate hole diameter can be improved. A variation of gate hole diameters of a flat display panel having a number of field emission elements can be reduced so that the electric characteristics of field emission elements can be made uniform and so the luminance of pixels of the display can be made uniform.

DETAILED DESCRIPTION OF THE PREFERRED EMBODIMENTS

FIGS. 1A to 1K are cross sectional views illustrating the manufacture steps for a field emission element according to a first embodiment of the invention. In the following, a field emission element having only an emitter (field emission cathode) is used by way of example for describing the manufacture steps.

Figure 1A:
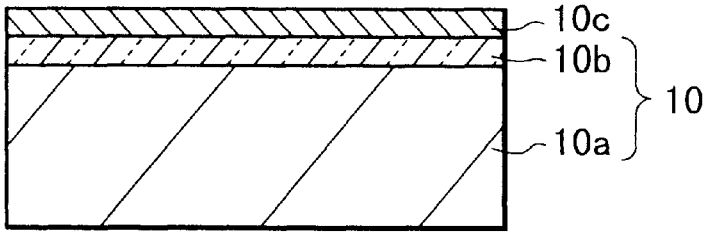
FIGS. 1A to 1K are cross sectional views illustrating the manufacture steps for a field emission element (emitter) according to a first embodiment of the invention.

As shown in FIG. 1A, a substrate 10 has a starting substrate 10*a* formed with a first lamination film 10*b*. The starting substrate 10*a* is made of Si, for example. The first lamination film 10*b* of $SiO_x$ ($SiO_2$) is formed through thermal oxidation on the surface of the starting substrate 10*a,* to a thickness of about 0.03 $\mu$m.

The thermal oxidation may be performed, for example, through wet (aqueous vapor) oxidation, by using a vertical furnace under the conditions of a hydrogen flow rate of 19 slm, an oxygen flow rate of 19 slm and a furnace temperature of 1000° C.

Next, a second lamination film 10*c* of polycrystalline silicon is deposited through low pressure CVD on the first lamination film 10*b* to a thickness of 0.05 $\mu$m. For example, the low pressure CVD is performed under the conditions of a source gas of $SiH_4$ having a concentration of 20% diluted with He, a pressure of 30 Pa and a substrate temperature of 625° C.

Figure 1B:
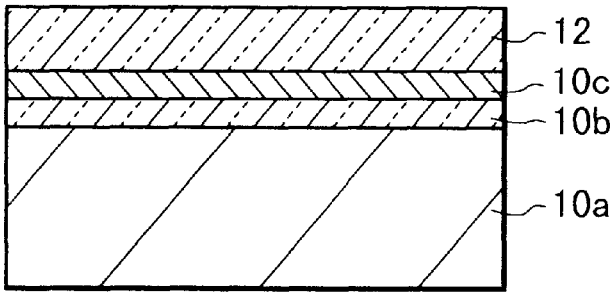

Next, as shown in FIG. 1B, a first sacrificial film (antireflection film) 12 of $SiN_x$ is deposited through reactive sputtering on the second lamination film 10*c* to a thickness of 0.14 $\mu$m. The antireflection film 12 provides an antireflection preventing effect relative to the surface of the second lamination film 10*c*.

The reactive sputtering is performed by using a DC sputtering system and Si as a sputtering target while $N_2$+Ar gas is introduced. Instead of sputtering, low pressure CVD may be used.

Figure 1C:
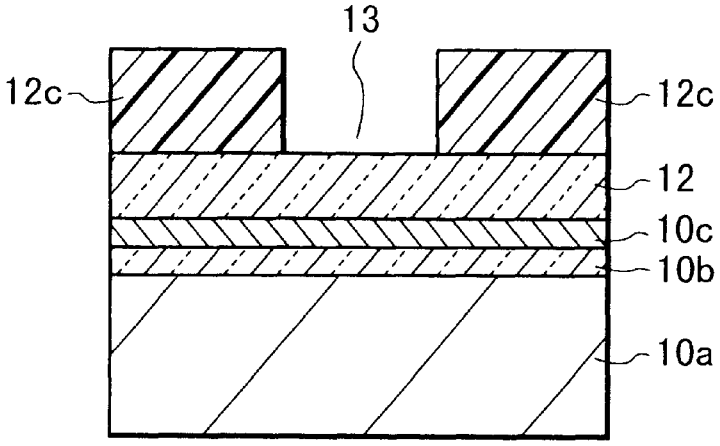
Figure 1D:
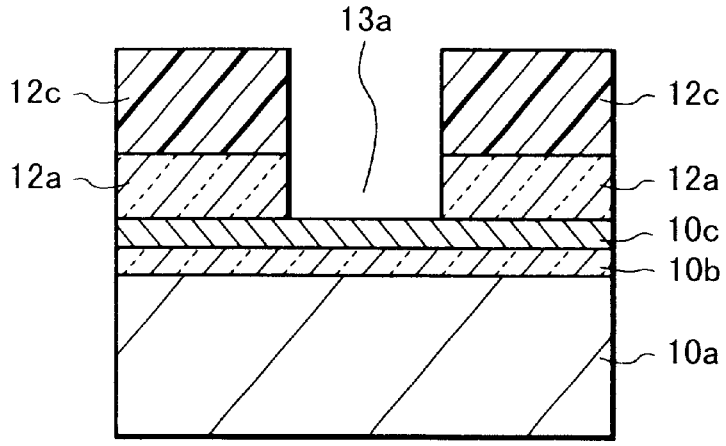

Next, as shown in FIG. 1C, a g-line resist mask pattern 12*c* having a hole 13 is formed on the antireflection film 12 through photolithography. First, a resist mask is coated on the whole surface of the antireflection film 12, and then exposed and developed to form the resist mask pattern 12*c* having a predetermined shape.

The antireflection film 12 can absorb light and/or can reduce the intensity of light reflected during exposure because of an interference between light reflected from the surface of the antireflection film 12 and light reflected from the underlying layer. Since a possibility of exposing an area other than a desired area with reflected light is small, the resist pattern 12*c* can be formed at a high resolution. If the antireflection film 12 is not formed and the resist film is deposited directly on the second lamination film 10*c,* the resist pattern 12*c* cannot be formed at a high resolution because of strong reflected light.

Next, by using the resist pattern 12*c* as a mask, the antireflection film 12 is anisotropically etched to form an antireflection film 12*a* having a predetermined pattern with a hole 13*a*. The hole 13*a* has a generally vertical inner wall and has a circular plan shape (as viewed from the upper surface) having a diameter of 0.8 $\mu$m. The antireflection film 12*a* is made of two parts (laterally separated regions) as viewed in section. Since the resist pattern 12*c* is formed at a high resolution, the antireflection film 12*a* having a predetermined pattern can also be formed at a high resolution.

For example, this etching is performed by using a magnetron RIE system under the conditions of an etching gas of $CHF_3$+$O_2$+Ar, a reaction chamber pressure of 60 mTorr, a flow ratio of $CHF_3/O_2/Ar$=15/3/75 (sccm), cooling He at 8 Torr, a magnetic field of 5 G (Gausses) and an RF power of 500 W.

Figure 1E:
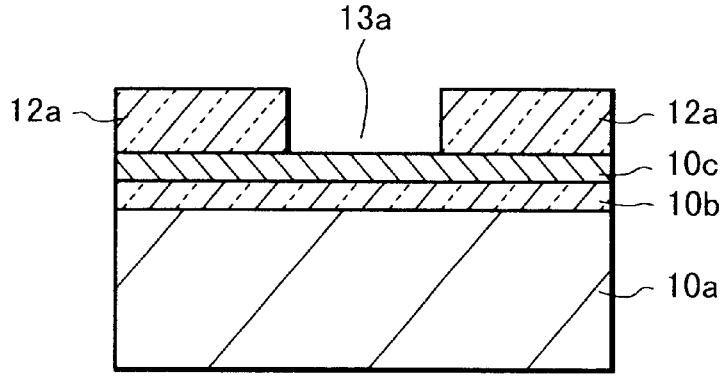

Next, as shown in FIG. 1E, the resist pattern 12*c* is removed to expose the upper surface of the antireflection film 12*a*.

Figure 1F:
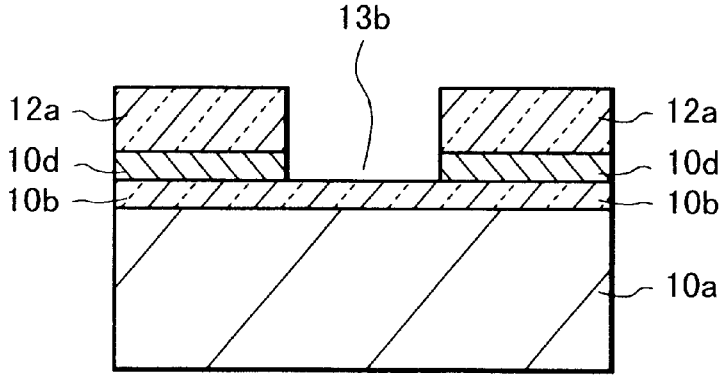

Next, as shown in FIG. 1F, by using the first sacrificial film (antireflection film) 12*a* as a mask, the second sacrificial film (polycrystalline silicon) 10*c* is etched to leave a second lamination film 10*d* having a predetermined pattern with a hole 13*b*. The resist pattern 12*c* and antireflection film 12*a* are formed at a high resolution so that the second lamination film 10*d* having a predetermined pattern can be formed at a high resolution.

As compared to a resist pattern used as a mask, the antireflection film 12*a* used as a mask for etching the second lamination film 10*c* improves an etching precision, an etching uniformity, an etching throughput and an etched cross section. As compared to a resist pattern used as a mask, the antireflection film 12*a* as a mask can be made thinner. As the antireflection film 12*a* becomes thin, adverse effects of microloading can be mitigated.

For example, the etching is performed by using a magnetron RIE system under the conditions of a HBr gas flow of 60 sccm, a pressure of 100 mTorr, an RF power of 150 W, a magnetic field of 30 G (Gausses) and cooling He at 4 Torr.

It is not limited only to that the second lamination film 10*d* is etched by using only the antireflection film 12*a* as a mask. By leaving the resist pattern 12*c* on the antireflection film 12*a* and using both the resist pattern 12*c* and antireflection film 12*a* as a mask, the second lamination film 10*d* may be etched. In this case, the resist pattern 12*c* is removed after this etching.

Figure 1G:
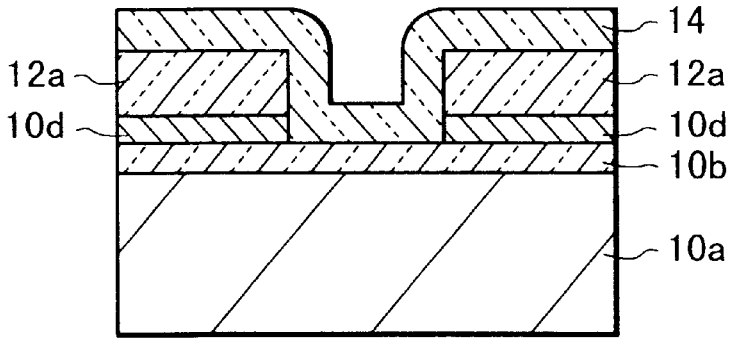

Next, as shown in FIG. 1G, a second sacrificial film (insulating film) 14 of $SiO_2$ is deposited on the whole substrate surface to a thickness of 0.25 $\mu$m through atmospheric pressure CVD. For example, the atmospheric pressure CVD is performed by using $O_3$ and TEOS (tetraethoxysilane) at a substrate temperature of 400° C.

Figure 1H:
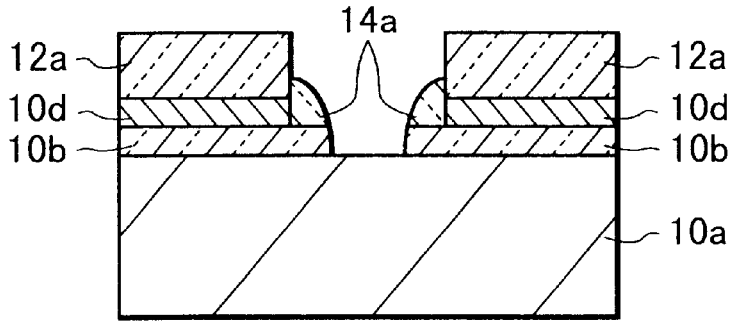

Next, as shown in FIG. 1H, the second sacrificial film (insulating film) 14 is anisotropically dry-etched (etched back) to leave as a side spacer a second sacrificial film 14*a* only on the inner walls of the antireflection film 12*a* and second lamination film 10*d*. This etching exposes the upper portion of the inner wall of the antireflection film 12*a* and etches also the first lamination film 10*b*. This etching stops at the starting substrate 10*a*.

For example, this etching is performed by using a magnetron RIE system under the conditions of an etching gas of $CHF_3$+$CO_2$+Ar, a reaction chamber pressure of 50 mTorr, a flow ratio of $CHF_3/CO_2/Ar$=60/10/30 (sccm), He at 8 Torr, a magnetic field of 30 G (Gausses) and an RF power of 700 W.

Figure 1I:
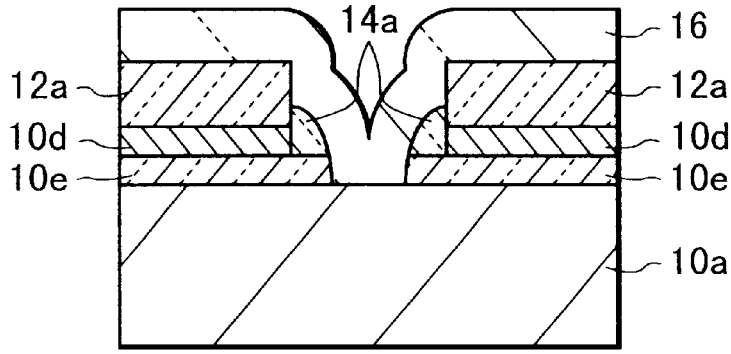

Next, as shown in FIG. 1I, a third sacrificial film (insulating film) 16 of $SiO_2$ is isotropically deposited on the whole substrate surface to a thickness of 0.15 $\mu$m through atmospheric pressure CVD. The third sacrificial film 16 is deposited while inheriting (being conformal to) the surface topology of the antireflection flm 12*a,* side spacer 14*a,* first lamination film 10*b*band starting substrate 10*a*. The surface shape of the third sacrificial film 16 is defined by a two-stage curve. The first stage curve (upper stage curve) is conformal to the corner shape of the antireflection film 12*a* and the second stage curve (lower stage curve) is conformal to the surface shape of the side spacer 14*a*.

A cusp of the third sacrificial film 16 has an acute angle like a contact point between two circles or ellipses. This portion with an acute angle is used as a mold for a two-stage shaped emitter electrode as in the following.

Figure 1J:
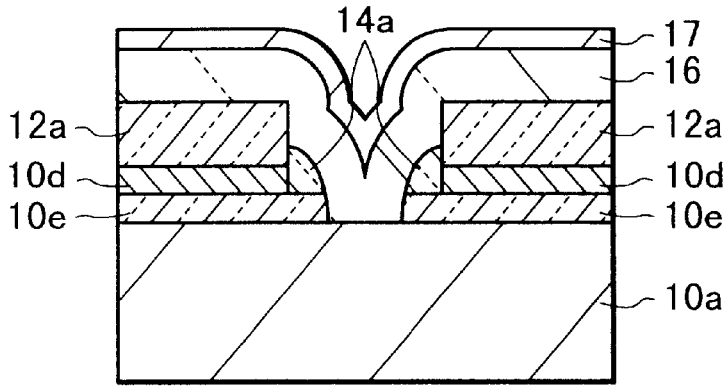

As shown in FIG. 1J, an emitter electrode 17 of, for example, $TiN_x$, is deposited on the third sacrificial film 16 to a thickness of about 0.2 $\mu$m through reactive sputtering. This reactive sputtering is performed by using a DC sputtering system and Ti as a sputtering target while $N_2$+Ar gas is introduced. In addition to $TiN_x$, the material of the emitter electrode 17 may be Mo, Cr, Ti or W.

Figure 1K:
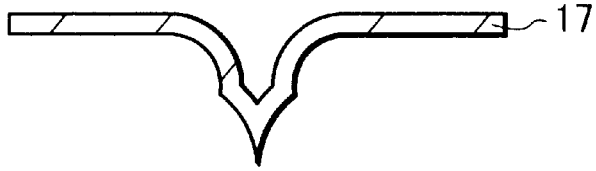

Next, the starting substrate 10*a,* first lamination film 10*e,* second lamination film 10*d,* antireflection film 12*a,* side spacer 14*a* and third sacrificial film 16 are etched and removed to form the emitter electrode 17 shown in FIG. 1K.

For etching silicon of the starting substrate 10*a* and the like, $HF+HNO_3+CH_3COOH$ is used, and for etching $SiO_2$ of the third sacrificial film 16 and the like, $HF+NH_4F$ is used. For etching the antireflection film ($SiN_x$) 12*a,* phosphoric acid ($HPO_3$) heated to 130 to 160° C. may be used. The first lamination film 10*e* functions as an etching stopper while the starting substrate 10*a* is etched.

Figure 16A:
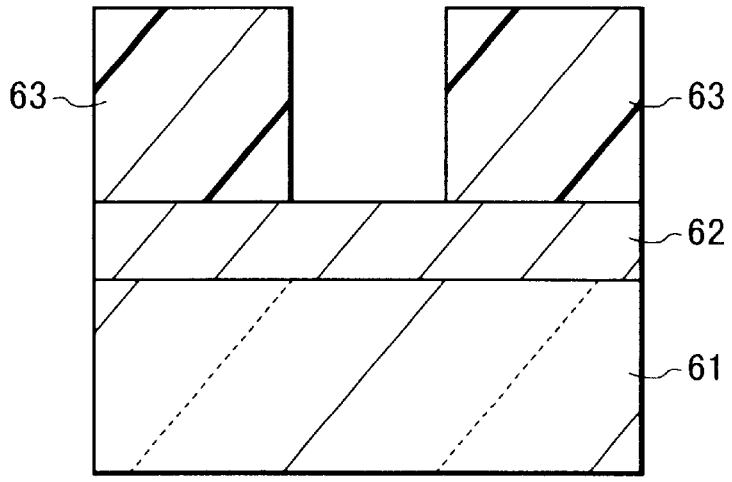
FIGS. 16A to 16F are cross sectional views of a substrate illustrating a conventional method of manufacturing a field emission element.
Figure 16B:
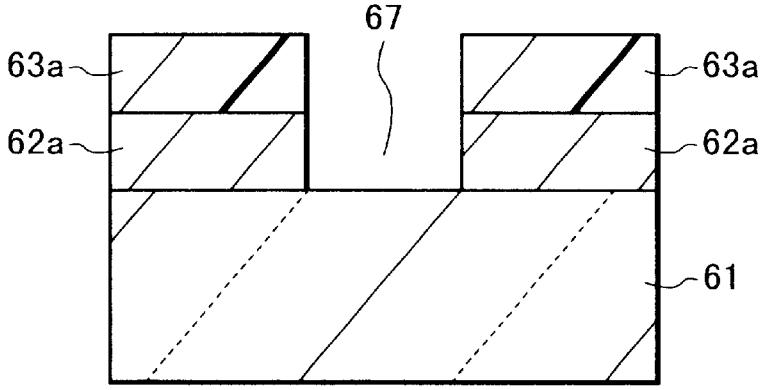
Figure 16C:
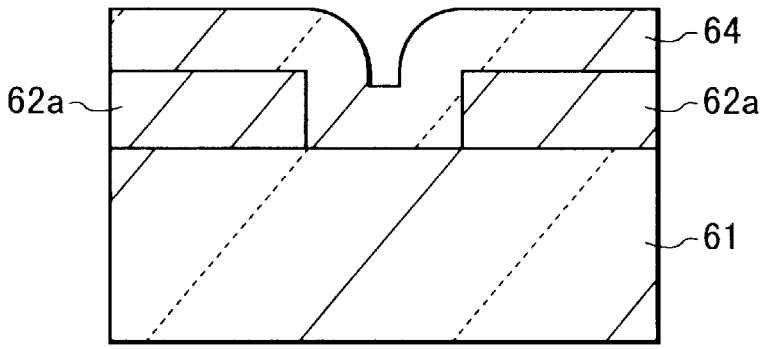
Figure 16D:
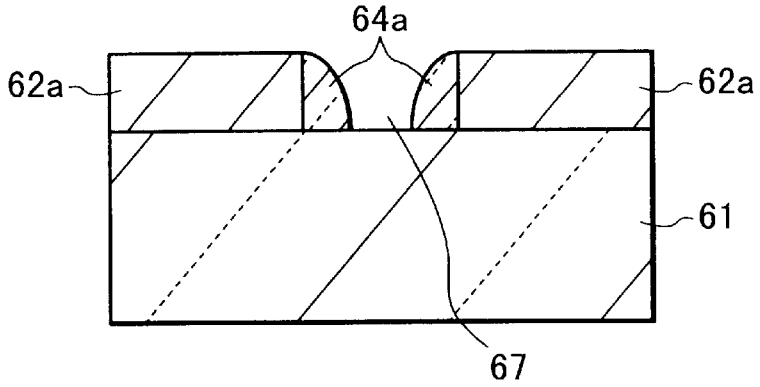
Figure 16E:
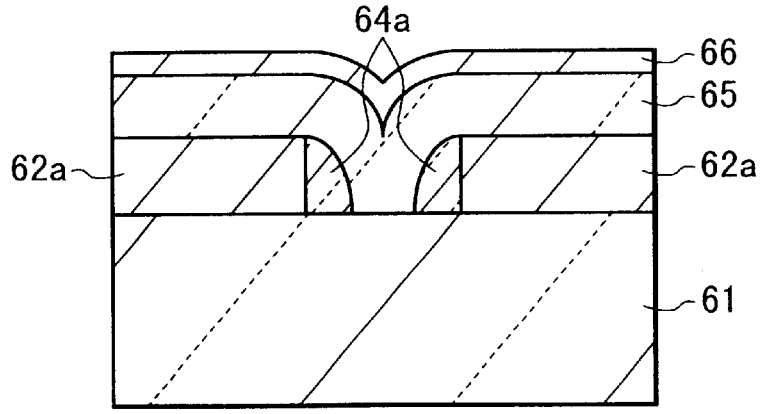
Figure 16F:
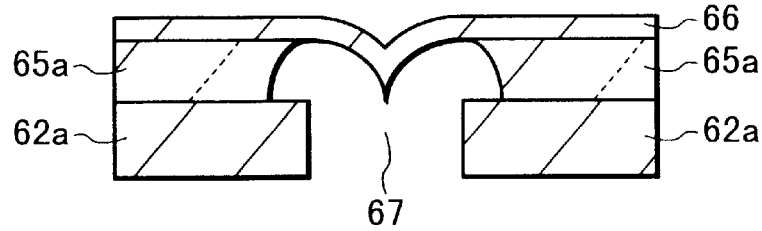

In this embodiment, the two-stage type emitter electrode 17 having two outer surfaces with a different radius of curvature can be formed. As compared to the first-stage type emitter electrode shown in FIG. 16F, the two-stage type emitter electrode can easily have a tip with a small radius of curvature and apex angle, so that an electric field concentrates easily on the tip of the emitter electrode and the electric performance of the field emission element can be improved.

As described above, since a resist film is formed on the antireflection film 12 and exposed and developed, the resist pattern 12*c* can be formed at a high resolution and high precision. By using the resist pattern 12*c* as a mask, the antireflection film 12 is etched, and by using the antireflection film 12*a* as a mask, the second lamination film 10*c* is etched. In this manner, the antireflection film pattern 12*a* and second lamination film pattern 10*d* can be formed at a high resolution and high precision. By depositing thereafter the third sacrificial film 16, the shape and size of the third sacrificial film 16 to be used for the mold of the emitter electrode 17 can be controlled at a high precision. By using this mold, the emitter electrode 17 is deposited so that the shape and size of the emitter electrode 17 can be controlled also at a high precision.

Figure 2A:
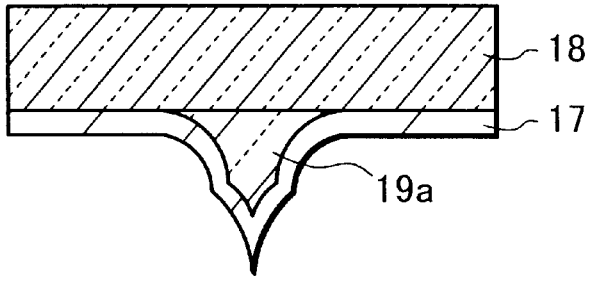
FIGS. 2A to 2C are diagrams illustrating three methods of reinforcing an emitter electrode by using a support substrate.
Figure 2B:
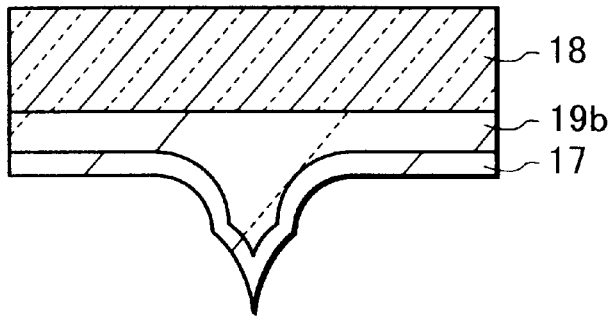
Figure 2C:
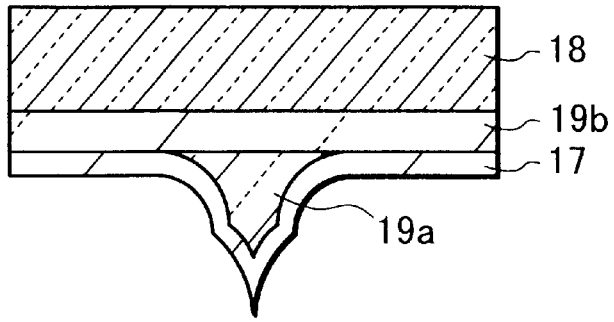

FIGS. 2A to 2C are cross sectional views illustrating three kinds of a method of reinforcing an emitter electrode 17 by using a support substrate 18. Since the emitter electrode 17 is as thin as about 0.2 $\mu$m, it is desired to reinforce the emitter electrode 17 with the support substrate 18.

FIG. 2A illustrates the first method. A bottom recess of the emitter electrode 17 manufactured as shown in FIG. 1J is filled with a planarizing film 19*a* of, for example, SOG (spin on glass). Thereafter, the planarizing film 19*a* is etched back through anisotropic dry etching, chemical mechanical polishing (CMP) or the like to planarize the bottom surface of the emitter electrode 17. The planarizing film 19*a* may be formed by reflowing PSG (phosphosilicate glass) or BPSG (borophosphosilicate glass) instead of using the SOG film.

Next, a support substrate 18 is adhered to the emitter electrode 17 through electrostatic bonding. The support substrate 17 is made of, for example, glass, quartz, or $Al_xO_y$.

Thereafter, the etching process illustrated in FIG. 1K is performed to remove the starting substrate 10*a* and the like to expose the lower surface of the emitter electrode as shown in FIG. 2A.

FIG. 2B illustrates the second method. Adhesive 19*b* such as low melting point glass is reflowed on the emitter electrode 17 in the state shown in FIG. 1J to adhere the emitter electrode 17 and a support substrate 18 together. The adhesive 19*b* also functions to planarize the bottom surface of the emitter electrode 17.

Instead of the low melting point glass, Al may be used as the adhesive 19*b*. In this case, the emitter electrode 17 and support substrate 18 may be adhered together by anodic bonding using electrostatic forces generated upon application of a high voltage of 1 kV between the support substrate 18 and adhesive 19*b* (or emitter electrode 17) and by maintaining the temperature at 400 to 500° C. If Al is used as the adhesive 19*b,* this Al layer may be used also as an emitter wiring.

Thereafter, the etching process illustrated in FIG. 1K is performed to remove the starting substrate 10*a* and the like to expose the lower surface of the emitter electrode 17 as shown in FIG. 2B.

FIG. 2C illustrates the third method. The bottom recess of the emitter electrode 17 in the state shown in FIG. 1J is filled with a planarizing film 19*a* made of, for example, SOG or W. Thereafter, the planarizing film 19*a* is etched back to planarize the bottom surface of the emitter electrode 17. A support substrate 18 is adhered to the emitter electrode 17 by using adhesive 19*b* such as Al. Thereafter, the process illustrated in FIG. 1K is performed to remove the starting substrate 10*s* and the like to expose the lower surface of the emitter electrode 17 as shown in FIG. 2C.

In the first embodiment, manufacture steps for a field emission element constituted of an emitter electrode have been described. Next, as another example of a field emission element, a two-electrode element is used and manufacture steps therefor will be described. A two-electrode element has two electrodes, an emitter electrode and a gate electrode.

FIGS. 3A to 3H are cross sectional views illustrating the manufacture steps for a field emission element (two-electrode element) according to a second embodiment of the invention.

Figure 3A:
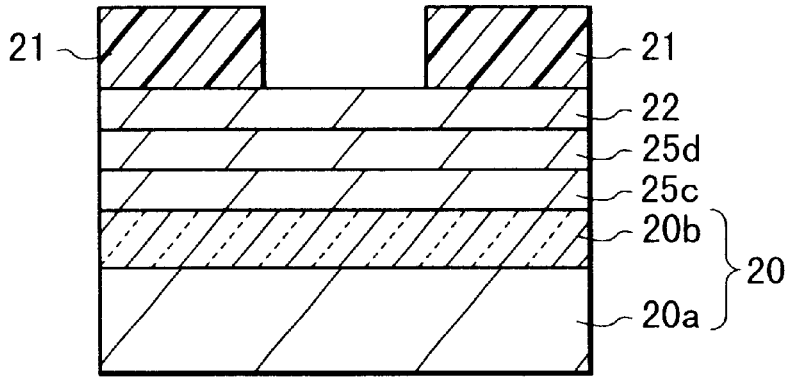
FIGS. 3A to 3H are cross sectional views illustrating the manufacture steps for a field emission element (two-electrode element) according to a second embodiment of the invention.

As shown in FIG. 3A, a substrate 20 has a starting substrate 20*a* and a first lamination film 20*b* formed thereon. The first lamination film (etching stopper film) 20*b* of $SiO_x$ ($SiO_2$) is formed through thermal oxidation on the surface of the starting substrate 20*a*.

Next, a first gate electrode film 25*c* of polycrystalline silicon doped with P or B is deposited through CVD on the first lamination film 20*b* to a thickness of 0.15 $\mu$m. On the first gate electrode film 25*c,* a second gate electrode film 25*d* of $WSi_x$ is deposited through CVD to a thickness of 0.15 $\mu$m. On the second gate electrode film 25*d,* a first sacrificial film (antireflection film) 22 of $TiN_x$ is deposited by reactive sputtering to a thickness of 0.04 $\mu$m.

Sputtering for the antireflection film ($TiN_x$) 22 is performed by using a DC sputtering system and Ti as a sputtering target while $N_2$+Ar gas is introduced. Instead of $N_2$+Ar gas, $N_2+O_2$+Ar gas may be used to deposit $TiO_xN_y$, $TiO_x$ or the like as the material of the antireflection film 22. $TiO_xN_y$ or is $TiO_x$ provides the antireflection effects of the antireflection film 22 more than $TiN_x$.

The antireflection film 22 has a refractive index smaller than the second gate film 25*d,* and has the antireflection effect relative to the surface of the second gate electrode film 25*d.* After the antireflection film 22 is formed, if the surface thereof is slightly etched, the antireflection effect of the antireflection film 22 can be improved further from the reason described above.

Figure 3B:
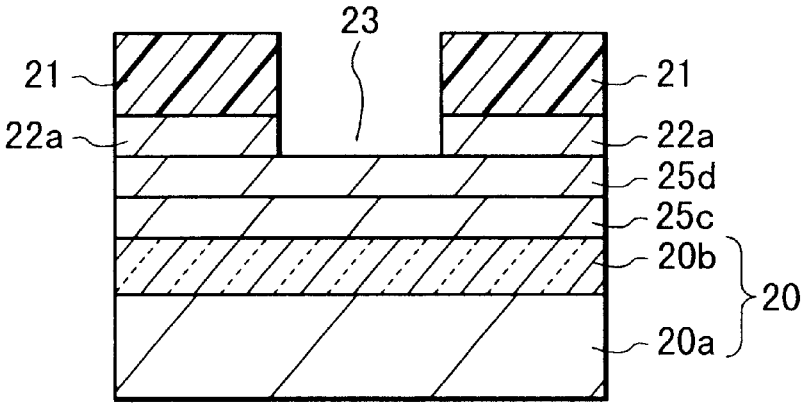

Next, an i-line resist mask film 21 having a predetermined shape is formed on the antireflection film 22 through photolithography by using an i-line stepper. Since the resist film 21 is formed on the antireflection film 22, the resist film 21 can be patterned at a higher resolution than the resist film 21. Next, as shown in FIG. 3B, by using the resist pattern 21 as a mask, the antireflection film 22 is anisotropically etched to form an antireflection film 22*a* having a predetermined pattern with a hole 23. The hole 23 has a generally vertical inner wall and has a circular plan shape (as viewed from the upper surface) having a diameter of 0.5 $\mu$m. The antireflection film 22*a* is made of two parts (laterally separated regions) as viewed in section. Since the resist pattern 21 is formed at a high resolution, the antireflection film 22*a* having a predetermined pattern can also be formed at a high resolution.

Figure 3C:
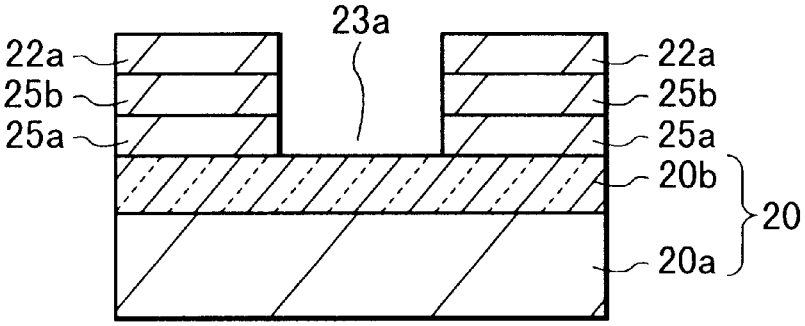

Next, as shown in FIG. 3C, after the resist pattern 21 is removed, by using the antireflection film 22*a* as a mask, the second gate electrode film 25*d* and first gate electrode film 25*c* are etched to leave first and second gate electrodes 25*a* and 25*b* having a predetermined pattern with a hole 23*a.* Since the antireflection film 22*a* is formed at a high resolution, the first and second gate electrodes 25*a* and 25*b* having a predetermined pattern can also be formed at a high resolution.

The first and second gate electrode films 25*c* and 25*d* may be etched by using the resist pattern 21 and antireflection film 22*a* as a mask without removing the resist pattern 21 on the antireflection film 22*a.*

After the second and first gate electrodes 25*d* and 25*c* are formed, the antireflection film 22*a* may be removed together with the resist pattern 21. For example, the antireflection film 22*a* and resist pattern 21 can be removed at the same time if $H_2SO_4$ (sulfuric acid)+$H_2O_2$ (hydrogen peroxide) heated to 120° is used.

Figure 3D:
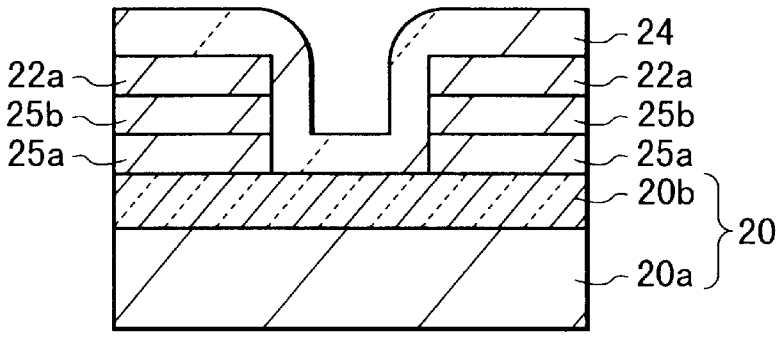

Next, as shown in FIG. 3D, a second sacrificial film (insulating film) 24 of polysilicon is deposited on the whole substrate surface to a thickness of 0.15 $\mu$m through low pressure CVD. Instead of polysilicon, the second sacrificial film may be formed by depositing amorphous silicon, $TiN_x$, $WSi_x$ or the like through CVD.

Figure 3E:
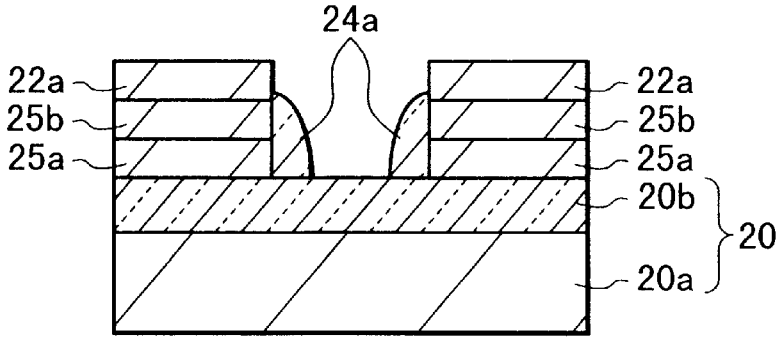

Next, as shown in FIG. 3E, the second sacrificial film 24 is anisotropically dry-etched to leave as a side spacer a second sacrificial film 24*a* only on the inner walls of the first and second gate electrodes and antireflection film 22*a.* This etching exposes the upper portion of the inner wall of the antireflection film 22*a* and also the surface of the first lamination film 20*b.* This etching stops at the first lamination film (etching stopper film) 20*b.* This etching is performed by using a magnetron RIE system under the conditions of an etching gas of HBr at 60 sccm, a pressure of 100 mTorr, an RF power of 150 W, a magnetic field of 30 G and He at 4 Torr.

Figure 3F:
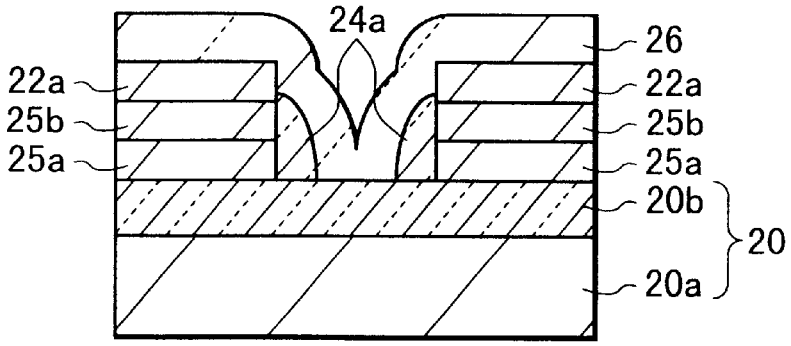

Next, as shown in FIG. 3F, a third sacrificial film (insulating film) 26 of $SiO_x$ is isotropically deposited on the whole substrate surface to a thickness of 0.15 $\mu$m through atmospheric pressure CVD. The third sacrificial film 26 is deposited while inheriting (being conformal to) the surface topology of the third sacrificial film 26, first lamination film 20*b,* side spacer 24*a,* and antireflection film 22*a.* The surface shape of the third sacrificial film 26 is defined by a two-stage curve. By utilizing this surface shape as a mold, a two-stage type emitter electrode is manufactured as in the following.

Figure 3G:
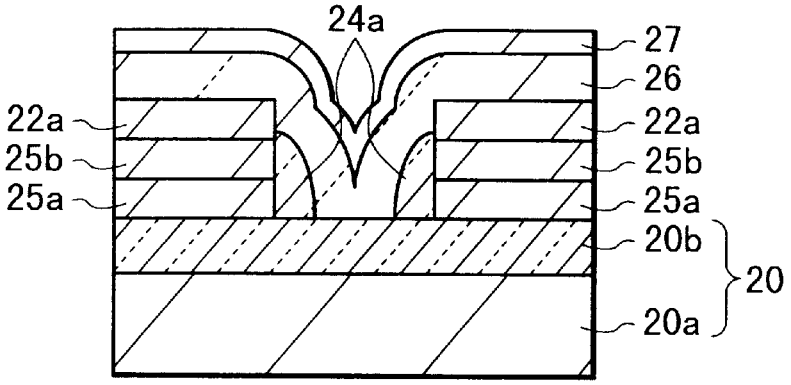

As shown in FIG. 3G, an emitter electrode 27 of, for example, $TiN_x$, is deposited on the third sacrificial film 26 to a thickness of about 0.2 $\mu$m through reactive sputtering. This reactive sputtering is performed by using a DC sputtering system and Ti as a sputtering target while $N_2$+Ar gas is introduced.

Figure 3H:
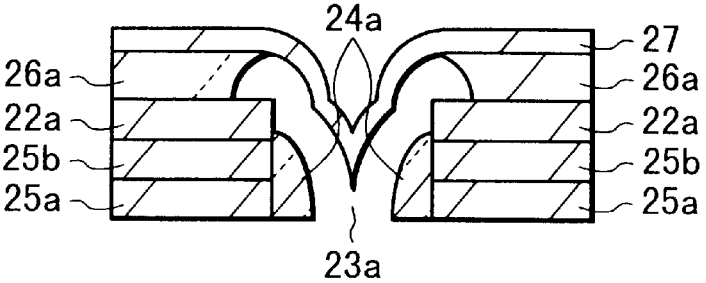

Next, as shown in FIG. 3H, the starting substrate 20*a* and first lamination film 20*b* and a portion of the third sacrificial film 26 are etched and removed to leave a peripheral third sacrificial film 26*a* and expose the tip of the emitter electrode 27.

For etching silicon of the starting substrate 20*a* and the like, HF+$HNO_3$+$CH_3COOH$ is used, and for etching $SiO_2$ and the like of the third sacrificial film 26 and the like, HF+$NH_4F$ is used.

With the above processes, a field emission element (two-electrode element) having the two-stage type emitter electrode 27 is completed. The antireflection film 22*a* made of a conductive film ($TiN_x$) functions as a third gate electrode. This field emission element has the emitter electrode 27 and gate electrodes 25*a,* 25*b* and 22*a.*

A negative potential is applied to the emitter electrode 27 and a positive potential is applied to an anode electrode disposed facing the emitter tip. When a positive potential is applied to the gate electrodes 25*a,* 25*b* and 22*a,* electrons are emitted from the emitter electrode 27 toward the anode electrode.

The gate electrodes 25*a,* 25*b* and 22*a* and side spacer 24*a* are formed surrounding the gate hole 23*a,* and made of two parts (laterally separated regions) as viewed in section. A space between the two parts is called a gate diameter. A voltage to be applied to the gate electrodes 25*a,* 25*b* and 22*a* and side spacer 24*a* is determined by the gate diameter. By using the side spacer 24*a,* the gate diameter can be made small so that an electric field at the tip of the emitter electrode 27 can be intensified and the electric performance can be improved.

By using the antireflection film 22, the gate electrode having a predetermined shape can be formed at a high precision. The gate diameter of the gate electrodes 25*a,* 25*b* and 22*a* and side spacer 24*a* can be precisely determined. In a flat panel display having a number of field emission elements, a variation in gate diameters can be reduced and the characteristics of field emission elements are made uniform. Namely, luminance of pixels of the display can be made uniform. Since the conductive material such as $TiN_x$ and $TiO_xN_y$ is used for the antireflection film 22*a,* the antireflection film 22*a* functions also as the gate electrode. Therefore, the gate resistance lowers and electromigration and stress migration can be prevented.

If polysilicon or $WSi_x$ is used as the material of the first and second gate electrodes 25*a* and 25*b,* generally P or B is doped in silicon and thereafter it is diffused through thermal annealing at 800 to 1000° C. Silicon and grain boundaries thereof of the first and second gate electrodes 25*a* and 25*b* have different etching rates. Therefore, the surfaces of the etched first and second gate electrodes become irregular. Although this problem does not occur if the annealing is not performed, the gate resistance does not lower without thermal annealing.

Even if the gate electrode is made of high resistance material such as polysilicon and $WSi_x$, the conductive antireflection film formed on the gate electrode can lower the gate resistance without thermal annealing.

FIGS. 4A to 4D are cross sectional views showing four kinds of structures which reinforce an emitter electrode 27 by using a support substrate 28. Since the emitter electrode 27 is as thin as about 0.2 $\mu$m, it is desired to reinforce the emitter electrode 27 with the support substrate 28.

Figure 4A:
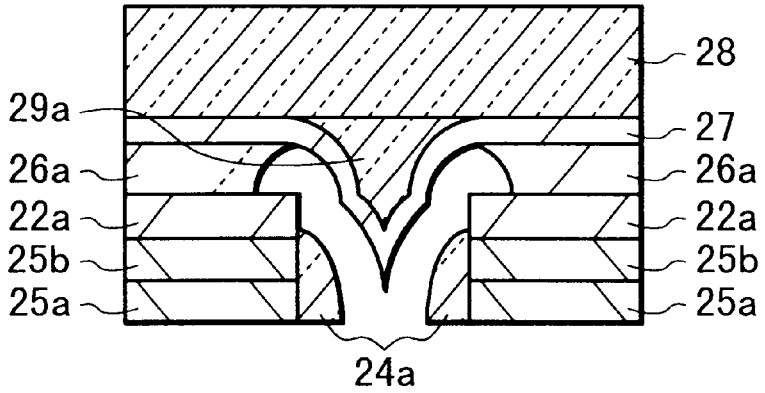
FIGS. 4A to 4D are diagrams illustrating four methods of reinforcing an emitter electrode by using a support substrate.

FIG. 4A illustrates a first method. A bottom recess of the emitter electrode 27 of the field emission element manufactured as shown in FIG. 3G is filled with a planarizing film 29*a* of, for example, SOG (spin on glass). Thereafter, the planarizing film 29*a* is etched back through anisotropic dry etching, chemical mechanical polishing (CMP) or the like to planarize the bottom surface of the emitter electrode 27. The planarizing film 29*a* may be formed by reflowing PSG (phosphosilicate glass) or BPSG (borophosphosilicate glass) instead of using the SOG film.

Figure 4B:
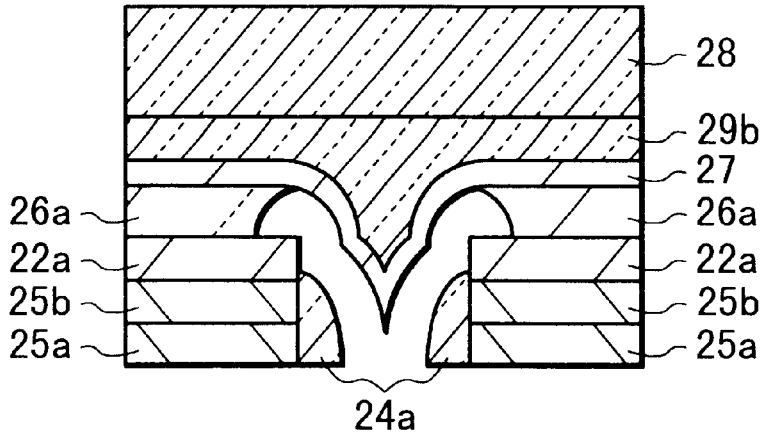

Next, a support substrate 28 is adhered to the emitter electrode 27 through electrostatic bonding or with adhesive. The support substrate 17 is made of, for example, glass, quartz, or $Al_xO_y$. Thereafter, the etching process illustrated in FIG. 3H is performed to remove the substrate 20*a* and first lamination film 20*b* and a portion of the third sacrificial film 26 to expose the tip of the emitter electrode 27 as shown in FIG. 4A. FIG. 4B illustrates a second method. Adhesive 29*b* such as low melting point glass or epoxy resin is reflowed on the emitter electrode 27 of a field emission element in the state shown in FIG. 3G to adhere the emitter electrode 27 and a support substrate 28 together. The adhesive 29*b* also functions to planarize the bottom surface of the emitter electrode 27. Thereafter, the etching process illustrated in FIG. 3H is performed to remove the starting substrate 20*a* and first lamination film 20*b* and a portion of the third sacrificial film 26 to expose the tip of the emitter electrode 27 as shown in FIG. 4B.

Figure 4C:
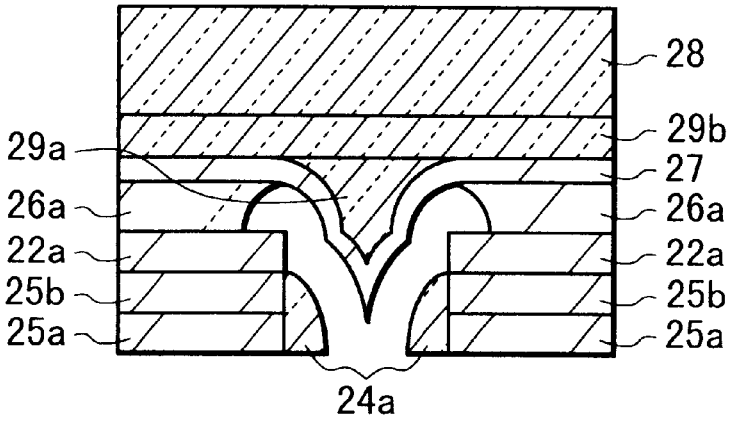

FIG. 4C illustrates a third method. The bottom recess on an outer surface of the emitter electrode 27 of a field emission element in the state shown in FIG. 3G is filled with a planarizing film 29*a* made of, for example, SOG. Thereafter, the planarizing film 29*a* is etched back to planarize the bottom surface of the emitter electrode 27 so as to make it flush with the surface of the planarizing film 29*a*. A support substrate 28 is adhered to the emitter electrode 27 by using adhesive 29*b* such as Al. Thereafter, the process illustrated in FIG. 3H is performed to remove the starting substrate 20*a* and first lamination film 20*b* and a portion of the third sacrificial film 26 to expose the tip of the emitter electrode 27 as shown in FIG. 4C.

Figure 4D:
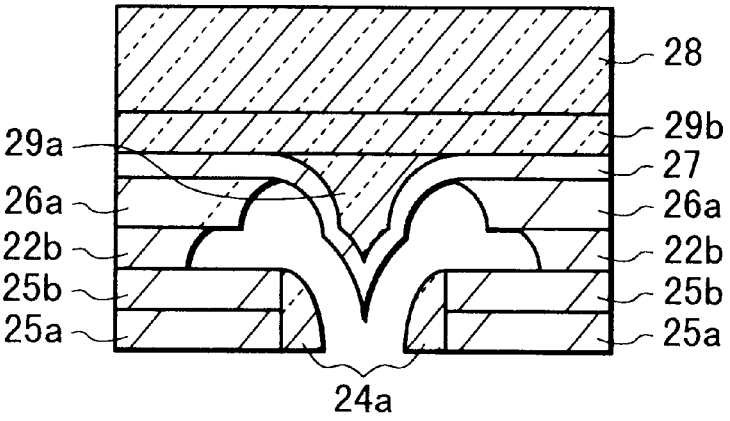

FIG. 4D illustrates a fourth method. Similar to the process used by the third method, an emitter electrode 27 and a support substrate 28 is adhered together with adhesive 29*b*. Thereafter, the process illustrated in FIG. 3H is performed to remove the starting substrate 20*a* and first lamination film 20*b* and a portion of the third sacrificial film 26, and the antireflection film 22*a* is wet-etched to leave an antireflection film 22*b* and expose the tip of the emitter electrode 27 as shown in FIG. 4D.

The antireflection film 22*a* of $TiN_x$ may be etched by liquid of mixture of sulfuric acid+hydrogen peroxide (e.g., at a mixture ratio of 1:1) heated to about 120°.

Figure 5A:
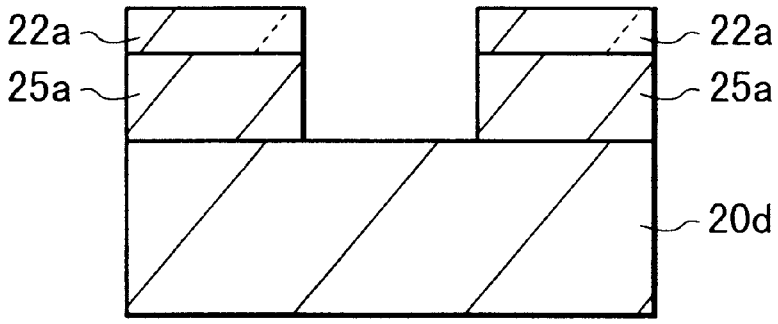
FIGS. 5A to 5F are cross sectional views illustrating the manufacture steps for a field emission element (two-electrode element) according to a modification of the second embodiment of the invention.

FIGS. 5A to 5F are cross sectional views illustrating the manufacture steps for a field emission element (two-electrode element) according to a modification of the second embodiment of the invention. As shown in FIG. 5A, a gate electrode film 25*a* and a first sacrificial film (antireflection film) 22*a* are worked to have a predetermined pattern on a starting substrate 20*d* of Si, through photolithography and etching. More specifically, on the starting substrate 20*d* of Si, a gate electrode film 25*a* of $AlSi_xCu_y$ (e.g., x=0.01 and y=0.01) is deposited through sputtering to a thickness of 0.3 $\mu$m, and on the gate electrode film 25*a*, an antireflection film 22*a* of $SiN_x$ is deposited through reactive sputtering to a thickness of 0.05 $\mu$m. Thereafter, the gate electrode film 25*a* and antireflection film 22*a* are patterned through photolithography and etching by using an i-line (365 nm) resist film and an i-line stepper. The antireflection film 22*a* provides the effect of preventing reflection at the surface of the gate electrode.

Sputtering for the gate electrode film 25*a* is performed by using a DC sputtering system and $AlSi_xCu_y$ as a target while Ar gas is introduced. The material of the gate electrode 25*a* may be Al, $AlCu_x$ (e.g., x=0.01), $AlSi_x$ (e.g., x=0.01) or $AlGe_x$ (e.g. x=0.01). Sputtering for the antireflection film 22*a* is performed by using a DC sputtering system and Si as a target while $N_2$+Ar gas is introduced. In place of sputtering, plasma CVD or low pressure CVD may be used.

Figure 5B:
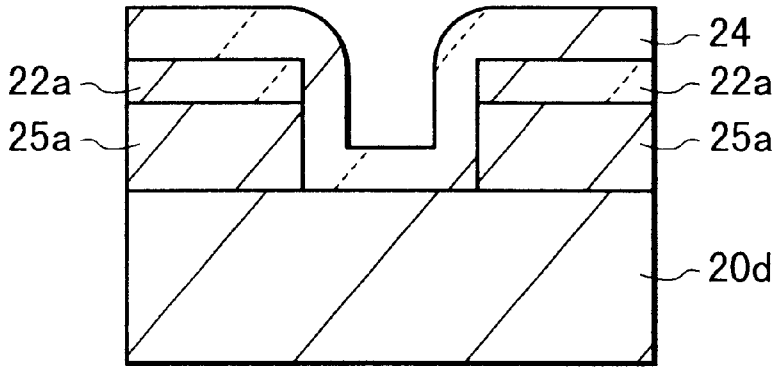

Next, as shown in FIG. 5B, a second sacrificial film (insulating film) 24 of $SiO_x$ is deposited on the whole substrate surface to a thickness of 0.15 $\mu$m through atmospheric CVD.

Figure 5C:
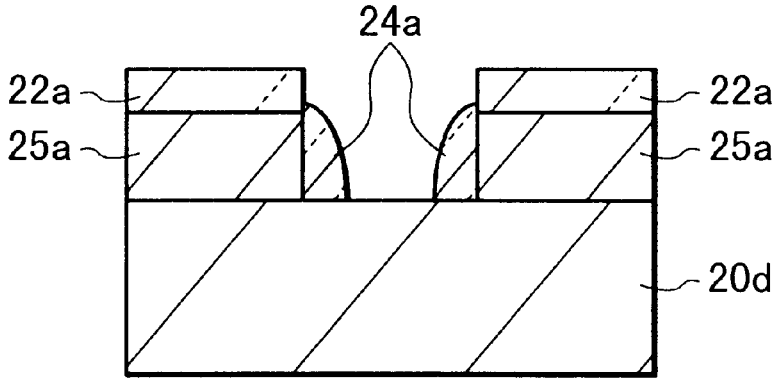

Next, as shown in FIG. 5C, the second sacrificial film 24 is anisotropically dry-etched to leave as a side spacer a second sacrificial film 24*a* only on the inner walls of the gate electrode 25*a* and antireflection film 22*a*. This etching exposes the upper portion of the inner wall of the antireflection film 22*a* and also the surface of the substrate 20*d*. This etching is performed by using a magnetron RIE system under the conditions of a flow ratio of $CHF_3/CO_2/Ar$=60/10/30 (sccm), a pressure of 50 mTorr, a magnetic field of 30 G, an RF power of 700 W and cooling He at 8 Torr.

Figure 5D:
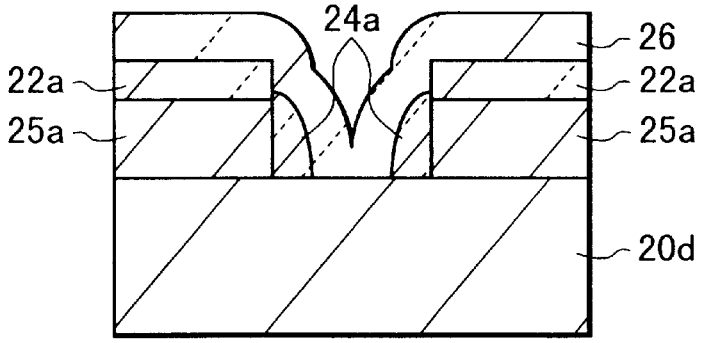

Next, as shown in FIG. 5D, a third sacrificial film (insulating film) 26 of $SiO_x$ (e.g., x=2) is isotropically deposited on the whole substrate surface to a thickness of 0.15 $\mu$m through atmospheric pressure CVD. The third sacrificial film 26 is deposited while inheriting (being conformal to) the surface topology of the third sacrificial film 26, substrate 20*d*, side spacer 24*a*, and antireflection film 22*a*. The surface shape of the third sacrificial film 26 is defined by a two-stage curve having different radii of curvature. By utilizing this surface shape as a mold, a two-stage type emitter electrode is manufactured as in the following.

Figure 5E:
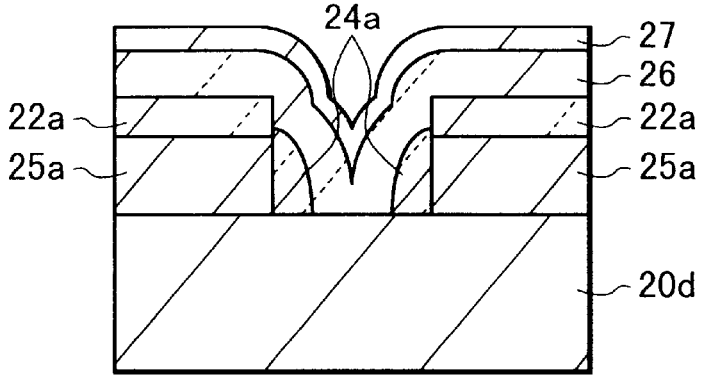

As shown in FIG. 5E, an emitter electrode 27 of, for example, $TiN_x$, is deposited on the third sacrificial film 26 to a thickness of about 0.2 $\mu$m through reactive sputtering. This reactive sputtering is performed by using a DC sputtering system and Ti as a sputtering target while $N_2$+Ar gas is introduced.

Figure 5F:
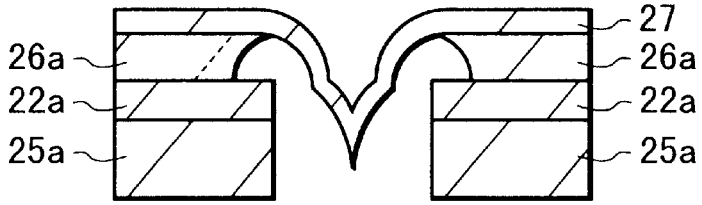

Next, as shown in FIG. 5F, the substrate 20*d* and side spacer 24*a* and a portion of the third sacrificial film 26 are etched and removed to leave a peripheral third sacrificial film 26*a* and expose the tip of the emitter electrode 27.

For etching silicon of the substrate 20*d* and the like, $HF+HNO_3+CH_3COOH$ (e.g., composition ratio of 1:1:1 to 1:1:5) is used, and for etching $SiO_x$ of the third sacrificial film 26 and the like, $HF+NH_4F$ is used.

With the above processes, a field emission element (two-electrode element) having the two-stage type emitter electrode 27 is completed. The field emission element has the emitter electrode 27 and the gate electrode 25*a*. Since the antireflection film 22*a* of $SiN_x$ (e.g., x=0.76) is formed on the gate electrode 25*a* of $AlSi_xCu_y$ (e.g., x=0.01 and y=0.005), the gate electrode having a predetermined shape can be formed at a high precision.

Since the antireflection film 22*a* is made of insulating material such as $SiN_x$ (e.g., x=0.76), $SiO_xN_y$ (e.g., x=0.11 and y=0.76), $SiO_x$ (e.g., x=1.3) and $TiO_x$ (e.g., x=2.0), a dielectric strength between the gate electrode 25*a* and emitter electrode 27 can be raised and an electrostatic capacitance therebetween can be reduced.

Figure 6A:
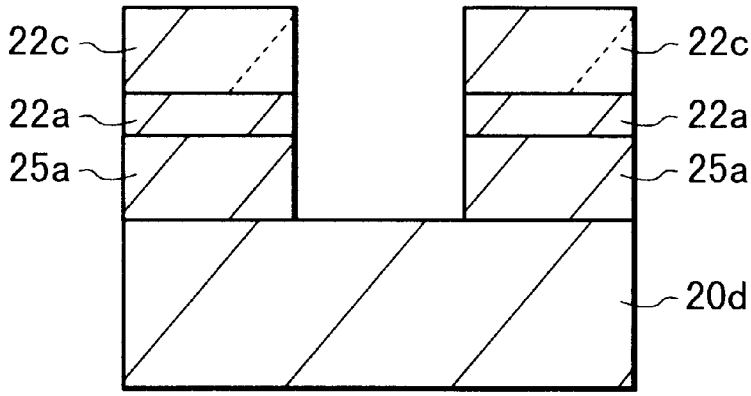
FIGS. 6A to 6F are cross sectional views illustrating the manufacture steps for a field emission element (two-electrode element) according to another modification of the second embodiment of the invention.

FIGS. 6A to 6F are cross sectional views illustrating the manufacture steps for a field emission element (two-electrode element) according to another modification of the second embodiment of the invention. As shown in FIG. 6A, similar to the above modification, a first gate electrode film 25*a,* a first sacrificial film (antireflection film) 22*a* and a second sacrificial film (antireflection film) 22*c,* respectively having a predetermined pattern, are formed on a starting substrate 20*d* of Si, through photolithography and etching.

More specifically, on the starting substrate 20*d* of Si, a gate electrode film 25*a* of $WSi_x$ is deposited through CVD to a thickness of 0.3 μm, an antireflection film 22*a* of $TiN_x$ is deposited on the gate electrode film 25*a* through reactive sputtering to a thickness of 0.04 μm, and a second sacrificial film 22*c* of $SiN_x$ is deposited on the antireflection film 22*a* through reactive sputtering to a thickness of 0.15 μm. Thereafter, the gate electrode film 25*a,* antireflection film 22*a* and second sacrificial film 22*c* are patterned through photolithography and etching. The antireflection film 22*a* provides the effect of preventing reflection at the surface of the first gate electrode 25*a.*

Sputtering for the antireflection film ($TiN_x$) 22*a* is performed by using a DC sputtering system and Ti as a target while $N_2$+Ar gas is introduced. Sputtering for the second sacrificial film ($SiN_x$) 22*c* is performed by using a DC sputtering system and Si as a target while $N_2$+Ar gas is introduced. In place of sputtering, plasma CVD or low pressure CVD may be used.

Figure 6B:
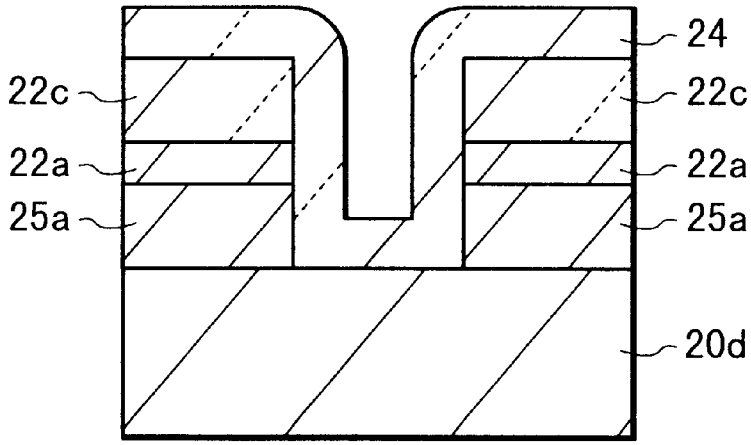

Next, as shown in FIG. 6B, a third sacrificial film (insulating film) 24 of $SiO_x$ (e.g., x=1.3) is deposited on the whole substrate surface to a thickness of 0.15 μm through atmospheric CVD.

Figure 6C:
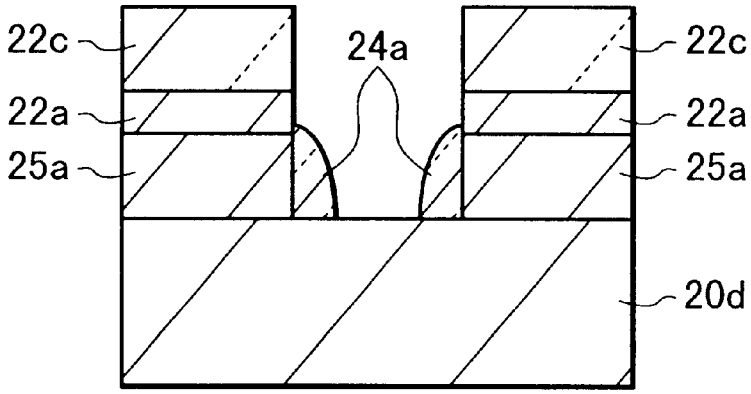

Next, as shown in FIG. 6C, the third sacrificial film 24 is anisotropically dry-etched to leave as a side spacer a third sacrificial film 24*a* only on the inner wall of the gate electrode 25*a.* This etching exposes the inner walls of the second sacrificial film 23*c* and antireflection film 22*a* and also the surface of the substrate 20*d.* This dry etching is performed by using a magnetron RIE system under the conditions of a flow ratio of $CHF_3/CO_2/Ar$=60/10/30 (sccm), a pressure of 50 mTorr, a magnetic field of 30 G, an RF power of 700 W and cooling He at 8 Torr.

Figure 6D:
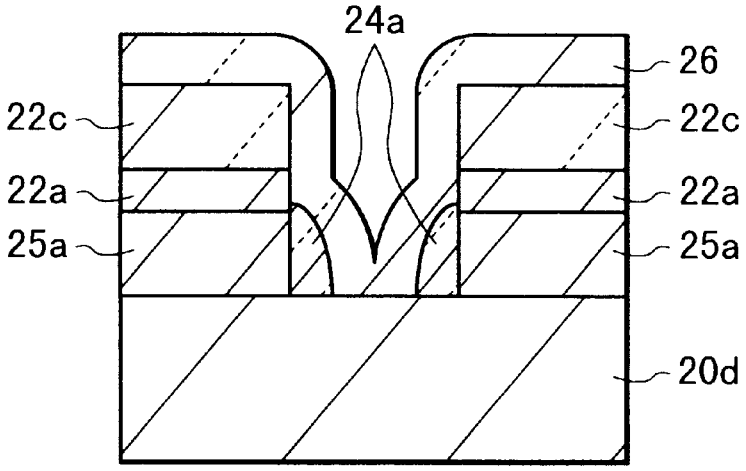

Next, as shown in FIG. 6D, a fourth sacrificial film (insulating film) 26 of $SiO_2$ is isotropically deposited on the whole substrate surface to a thickness of 0.15 μm through atmospheric pressure CVD. The fourth sacrificial film 26 is deposited while inheriting (being conformal to) the surface topology of the second sacrificial film 22*c,* antireflection film 22*a,* side spacer 24*a,* and substrate 20*d.* The surface shape of the third sacrificial film 26 is defined by a two-stage curve. By utilizing this surface shape as a mold, a two-stage type emitter electrode is manufactured as in the following.

Figure 6E:
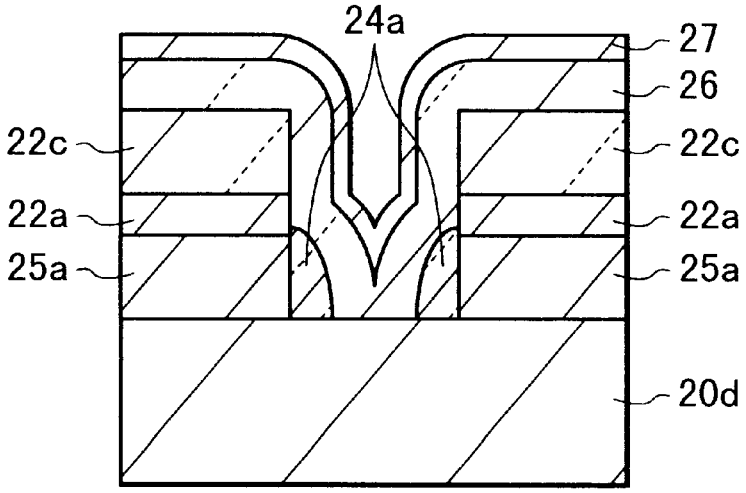

As shown in FIG. 6E, an emitter electrode 27 of, for example, $TiN_x$ (e.g., x=1), is deposited on the fourth sacrificial film 26 to a thickness of about 0.2 μm through reactive sputtering.

Figure 6F:
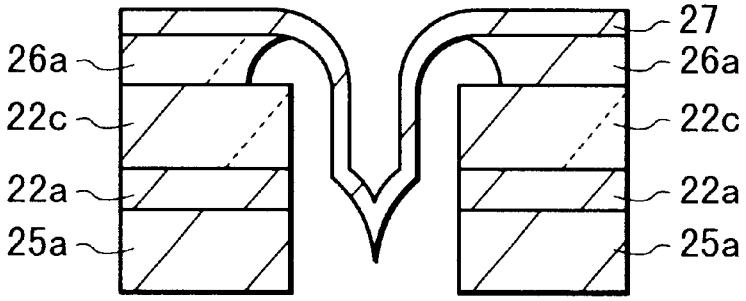

Next, as shown in FIG. 6F, the substrate 20*d* and side spacer 24*a* and a portion of the fourth sacrificial film 26 are etched and removed to leave a peripheral fourth sacrificial film 26*a* and expose the tip of the emitter electrode 27.

With the above processes, a field emission element (two-electrode element) having the two-stage type emitter electrode 27 is completed. Since the antireflection film 22*a* is a conductive film ($TiN_x$) it servers as the second gate electrode. Since the antireflection film 22*a* of $TiN_x$ is formed on the first gate electrode 26*a* of $WSi_x$, the gate electrode having a predetermined shape can be formed at a high precision.

Figure 7A:
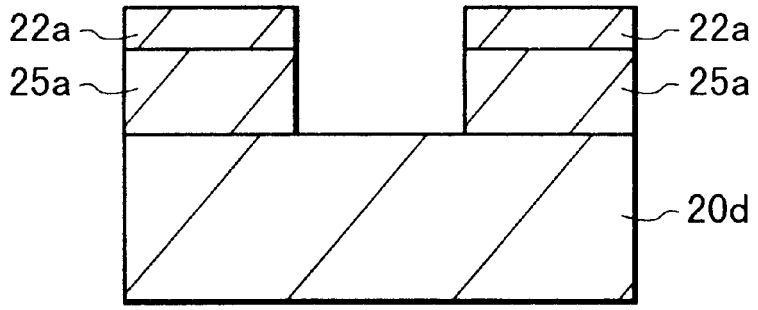
FIGS. 7A to 7F are cross sectional views illustrating the manufacture steps for a field emission element (two-electrode element) according to another modification of the second embodiment of the invention.

FIGS. 7A to 7F are cross sectional views illustrating the manufacture steps for a field emission element (two-electrode element) according to another modification of the second embodiment of the invention. As shown in FIG. 7A, similar to the manufacture steps for a field emission element of the second embodiment, a gate electrode film 25*a* and a first sacrificial film (antireflection film) 22*a* having a predetermined pattern are formed on a starting substrate 20*d* of Si, through photolithography and etching.

More specifically, on the starting substrate 20*d* of Si, a gate electrode film 25*a* of polysilicon doped with P or B is deposited through CVD to a thickness of 0.15 μm, and on the gate electrode film 25*a,* an antireflection film 22*a* of $TiN_x$ is deposited through reactive sputtering to a thickness of 0.04 μm. Thereafter, photolithography is executed by using an i-line stepper and an i-line resist film. By using the formed resist pattern as a mask, the gate electrode film 25*a* and antireflection film 22*a* are patterned. The antireflection film 22*a* provides the effect of preventing reflection at the surface of the gate electrode 25*a.*

Sputtering for the antireflection film ($TiN_x$) 22*a* is performed by using a DC sputtering system and Ti as a target while $N_2$+Ar gas is introduced.

Figure 7B:
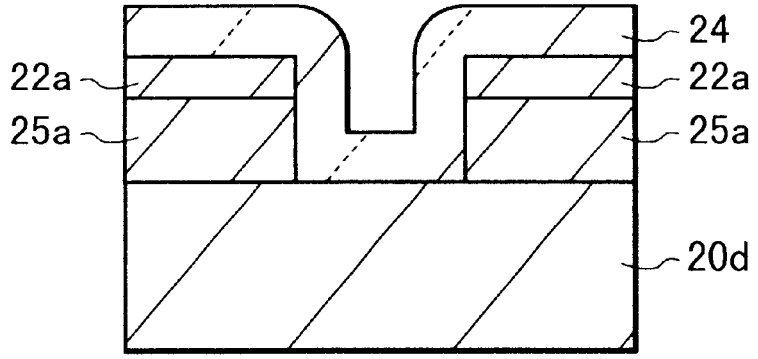

Next, as shown in FIG. 7B, a second sacrificial film (insulating film) 24 of $SiO_2$ is deposited on the whole substrate surface to a thickness of 0.15 μm through atmospheric CVD.

Figure 7C:
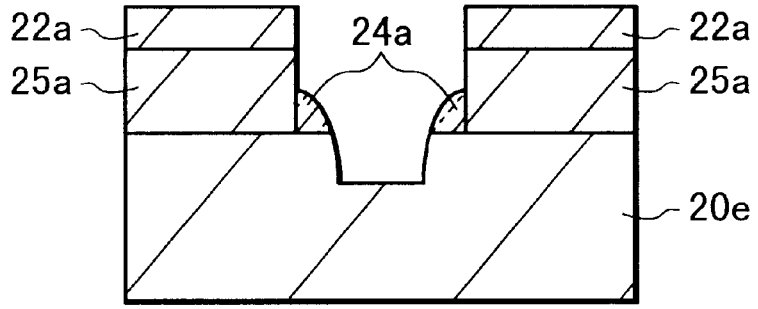

Next, as shown in FIG. 7C, the second sacrificial film 24 is anisotropically dry-etched to leave as a side spacer a second sacrificial film 24*a* only on the inner wall of the gate electrode 25*a.* This etching exposes the inner wall of the antireflection film 22*a* and also the upper inner wall of the gate electrode 25*a,* and stops when the substrate 20*d* is etched by 0.1 μm in depth. This etching therefore forms a substrate 20*e* having a recess. This etching is performed by using a magnetron RIE system under the conditions of a flow ratio of $CHF_3/CO_2/Ar$=8/32/30 (sccm), a pressure of 50 mTorr, a magnetic field of 30 G, an RF power of 700 W and cooling He at 8 Torr.

Figure 7D:
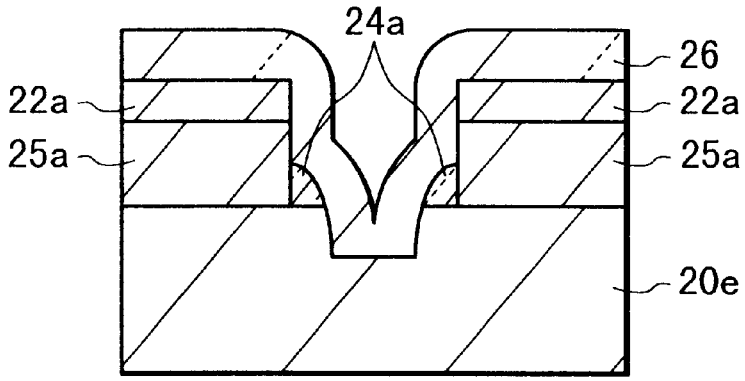

Next, as shown in FIG. 7D, a third sacrificial film (insulating film) 26 of $SiO_x$ is isotropically deposited on the whole substrate surface to a thickness of 0.15 μm through atmospheric pressure CVD. The third sacrificial film 26 is deposited while inheriting (being conformal to) the surface topology of the substrate 20*e,* side spacer 24*a,* gate electrode 25*a* and antireflection film 22*a.* The surface shape of the third sacrificial film 26 is defined by a two-stage curve. By utilizing this surface shape as a mold, a two-stage type emitter electrode is manufactured as in the following.

Figure 7E:
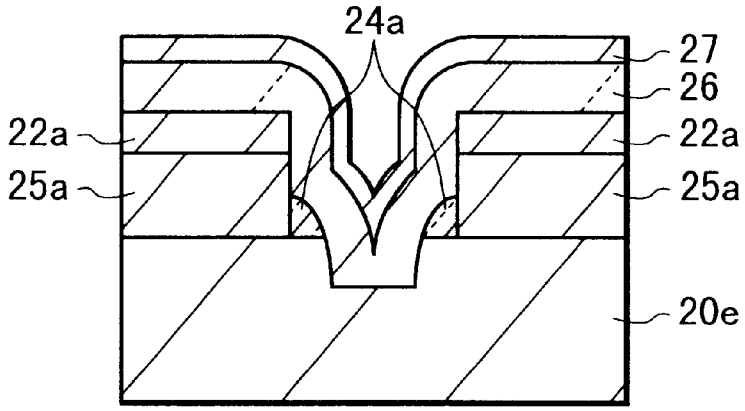
Figure 7F:
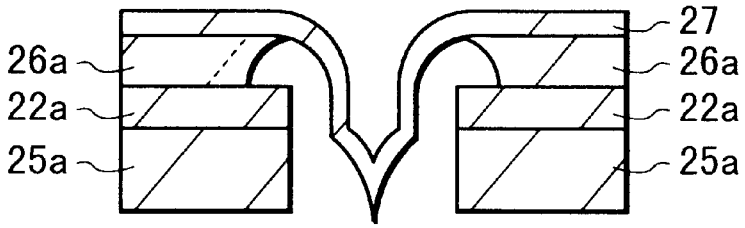

As shown in FIG. 7E, an emitter electrode 27 of, for example, $TiN_x$, is deposited on the third sacrificial film 26 to a thickness of about 0.2 μm through reactive sputtering. Next, as shown in FIG. 7F, the substrate 20*e* and side spacer 24*a* and a portion of the third sacrificial film 26 are etched and removed to leave a peripheral third sacrificial film 26*a* and expose the tip of the emitter electrode 27.

Since the substrate 20*e* is formed with a recess by the etching process shown in FIG. 7C, the position of the tip of the emitter electrode 27 of this two-electrode element can be lowered relative to the gate electrode 25*a* more than the two-electrode element shown in FIG. 6F.

Figure 8A:
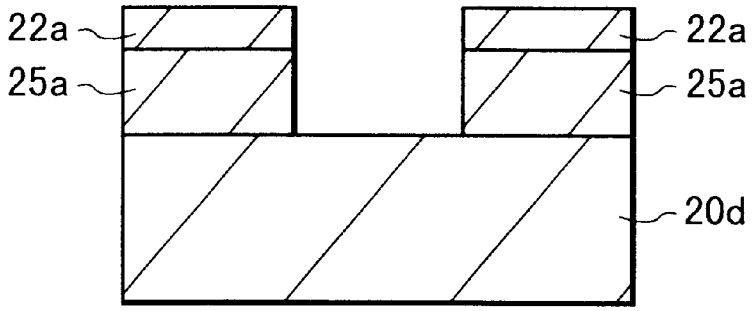
FIGS. 8A to 8F are cross sectional views illustrating the manufacture steps for a field emission element (two-electrode element) according to another modification of the second embodiment of the invention.

With the above processes, a field emission element (two-electrode element) having the two-stage type emitter electrode 27 is completed. Since the antireflection film 22*a* is made of a conductive film ($TiN_x$), it also serves as the second gate electrode. This field emission element has the emitter electrode 27 and the gate electrodes 25*a* and 22*a*. Since the antireflection film 22*a* of $TiN_x$ is formed on the gate electrode 25*a* of polysilicon, the gate electrode having a predetermined shape can be formed at a high precision. FIGS. 8A to 8F are cross sectional views illustrating the manufacture steps for a field emission element (two-electrode element) according to another modification of the second embodiment of the invention. As shown in FIG. 8A, similar to the manufacture steps for a field emission element of the second embodiment, a gate electrode film 25*a* and a first sacrificial film (antireflection film) 22*a* having a predetermined pattern are formed on a starting substrate 20*d* of Si, through photolithography and etching.

More specifically, on the starting substrate 20*d* of Si, a gate electrode film 25*a* of polysilicon doped with P or B is deposited through CVD to a thickness of 0.15 $\mu$m, and on the gate electrode film 25*a,* an antireflection film 22*a* of $TiN_x$ is deposited through reactive sputtering to a thickness of 0.04 $\mu$m. Thereafter, by using an i-line stepper and an i-line resist film, the gate electrode film 25*a* and antireflection film 22*a* are patterned through photolithography and etching. The antireflection film 22*a* provides the effect of preventing reflection at the surface of the gate electrode 25*a.*

Figure 8B:
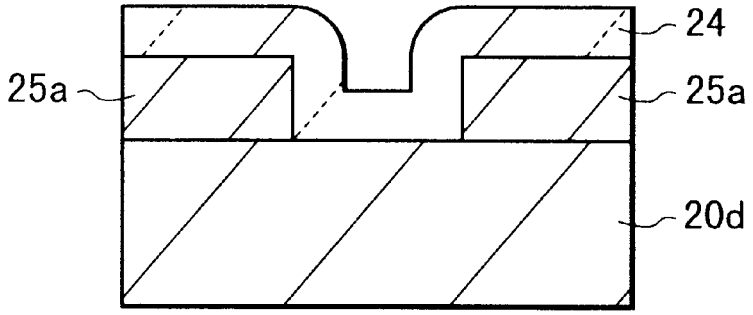

Next, as shown in FIG. 8B, after the antireflection film 22*a* is etched and removed, a second sacrificial film (insulating film) 24 of $SiO_x$ is deposited on the surfaces of the substrate 20*d* and gate electrode 25*a* to a thickness of 0.15 $\mu$m through atmospheric CVD.

The antireflection film ($TiN_x$) 22*a* is etched by liquid of mixture of sulfuric acid+hydrogen peroxide (e.g. a mixture ratio of 1:1) heated to about 120°.

Figure 8C:
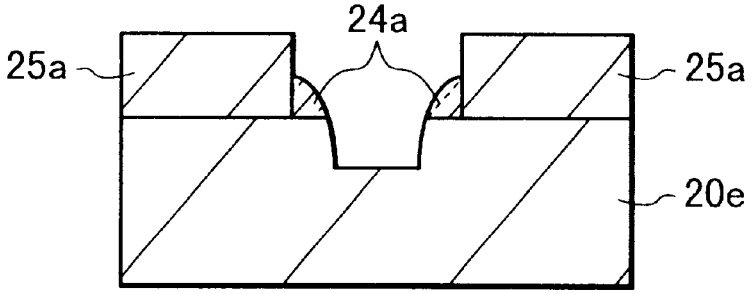

Next, as shown in FIG. 8C, the second sacrificial film 24 is anisotropically dry-etched to leave, as a side spacer, of a second sacrificial film 24*a* only on the inner wall of the gate electrode 25*a*. This etching exposes the upper inner wall of the gate electrode 25*a* and stops when the substrate 20*d* is etched by 0.1 $\mu$m in depth. This etching therefore forms a substrate 20*e* with a recess. This etching is performed by using a magnetron RIE system under the conditions of a flow ratio of $CHF_3/CO_2/Ar$=60/10/30 (sccm), a pressure of 50 Torr, a magnetic field of 30 G, an RF power of 700 W and cooling He at 8 Torr.

Figure 8D:
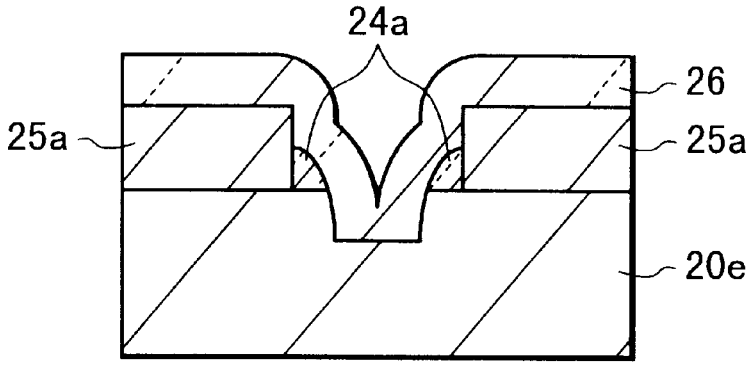

Next, as shown in FIG. 8D, a third sacrificial film (insulating film) 26 of $SiO_x$ is isotropically deposited on the whole substrate surface to a thickness of 0.15 $\mu$m through atmospheric pressure CVD. The third sacrificial film 26 is deposited while inheriting (being conformal to) the surface topology of the substrate 20*e,* side spacer 24*a* and gate electrode 25*a.* The surface shape of the third sacrificial film 26 is defined by a two-stage curve. By utilizing this surface shape as a mold, a two-stage type emitter electrode is manufactured as in the following.

Figure 8E:
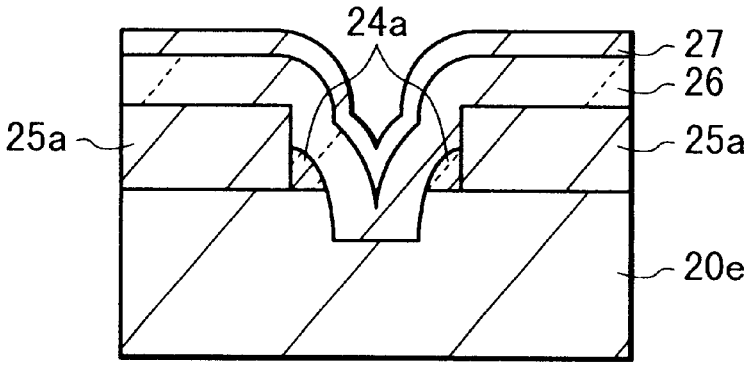
Figure 8F:
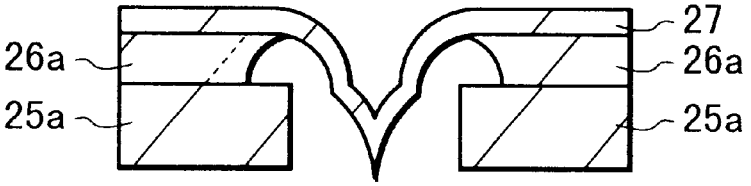

As shown in FIG. 8E, an emitter electrode 27 of, for example, $TiN_x$, is deposited on the third sacrificial film 26 to a thickness of about 0.2 $\mu$m through reactive sputtering. Next, as shown in FIG. 8F, the substrate 20*e* and side spacer 24*a* and a portion of the third sacrificial film 26 are etched and removed to leave a peripheral third sacrificial film 26*a* and expose the tip of the emitter electrode 27.

With the above processes, a field emission element (two-electrode element) having the two-stage type emitter electrode 27 is completed. This field emission element has the emitter electrode 27 and the gate electrode 25*a.* Since the antireflection film 22*a* of $TiN_x$ is formed on the gate electrode 25*a* of polysilicon, the gate electrode having a predetermined shape can be formed at a high precision. The antireflection film 22*a* is thereafter removed so that it is not left in the final field emission element shown in FIG. 8F.

In the second embodiment and its modifications, manufacture methods for a field emission element constituted of an emitter electrode and a gate electrode have been described. Next, as another example of a field emission element, a three-electrode element is used and manufacture methods therefor will be described. A three-electrode element has three electrodes, an emitter electrode, a gate electrode and an anode electrode.

FIGS. 9A to 9L are cross sectional views illustrating the manufacture steps for a field emission element (three-electrode element) according to a third embodiment of the invention.

Figure 9A:
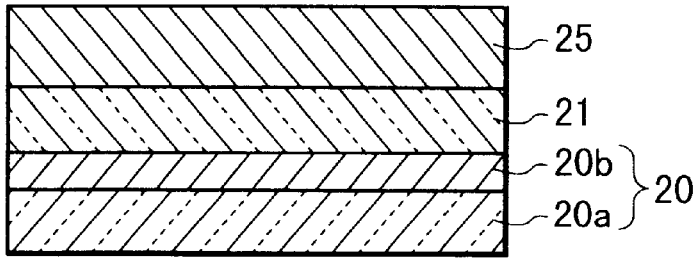
FIGS. 9A to 9L are cross sectional views illustrating the manufacture steps for a field emission element (three-electrode element) according to a third embodiment of the invention.

As shown in FIG. 9A, a substrate 20 has a starting substrate 20*a* and an anode electrode layer 20*b* The anode electrode film 20*b* is made of $AlSi_xCu_y$ (e.g., x=0.01 and y=0.005) and deposited through sputtering to a thickness of 0.3 $\mu$m on the starting substrate 20*a* made of Si. Sputtering for the anode electrode ($AlSi_xCu_y$) is performed by using a DC sputtering system and $AlSi_xCu_y$ (e.g., x=0.01 and y=0.005) as a target while Ar gas is introduced.

Next, a first sacrificial film (insulating film) 21 of $SiO_x$ is deposited on the anode electrode 20*b* by plasma CVD or atmospheric pressure CVD, and on the first sacrificial film 21, a gate electrode of $AlSi_xCu_y$ is deposited by sputtering in the method similar to the above.

Figure 9B:
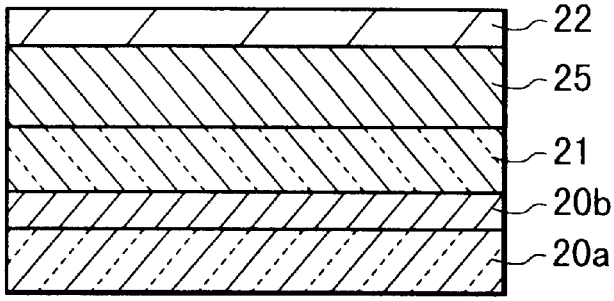

Next, as shown in FIG. 9B, a second sacrificial film (antireflection film) 22 of $TiN_x$ (e.g., x=1) is deposited by sputtering to a thickness of 0.04 $\mu$m on the gate electrode 25. Sputtering for the antireflection film ($TiN_x$) is performed by using a DC sputtering system and Ti as a target while $N_2$+Ar gas is introduced.

The antireflection film 22 provides an effect of preventing reflection at the surface of the gate electrode 25. If the surface of the antireflection film 22 is etched, the antireflection effect can be improved. If $TiO_xN_y$ or $TiN_x$ is used as the material of the antireflection film 22 and the surface of the film 22 is etched, grain boundaries are selectively etched so that needle-like crystals are emphasized and a reflectance lowers further by a resonance effect.

As the material of the antireflection film 22, $TiO_xN_y$ or $TiO_x$ (insulating material) may be used in place of $TiN_x$ (conductive material). $TiO_xN_y$ or $TiO_x$ provides an antireflection effect of the antireflection film more than $TiN_x$.

Figure 9C:
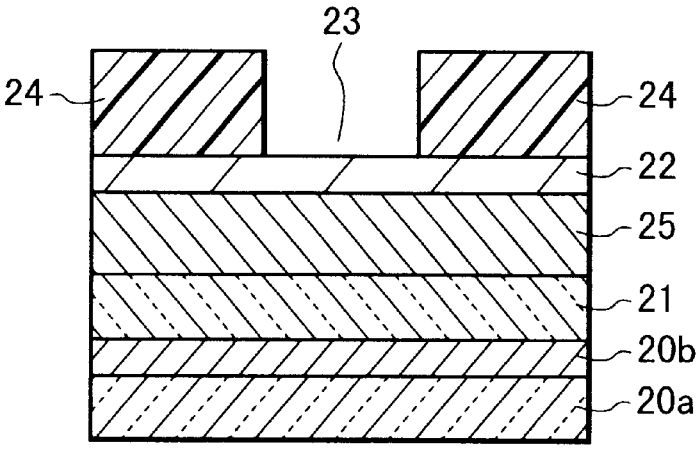

Next, as shown in FIG. 9C, a resist pattern 24 having a predetermined shape is formed on the antireflection film 22 through photolithography by using an i-line stepper and an i-line resist film. Since the antireflection film 22 provides the antireflection effect, the resist pattern 24 can be formed at a high resolution.

Figure 9D:
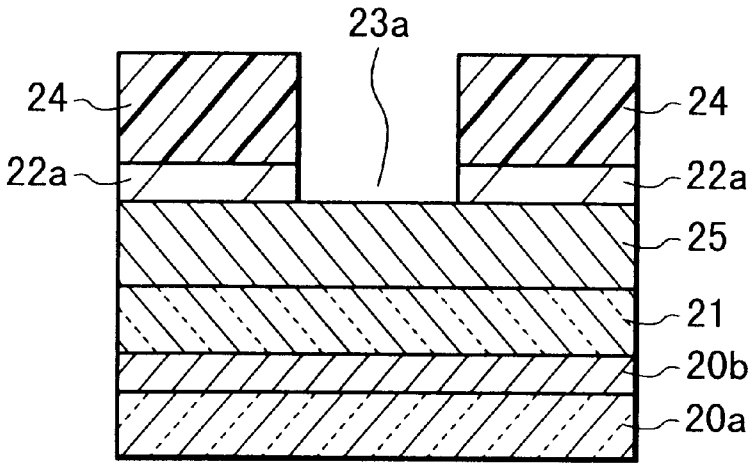
Figure 9E:
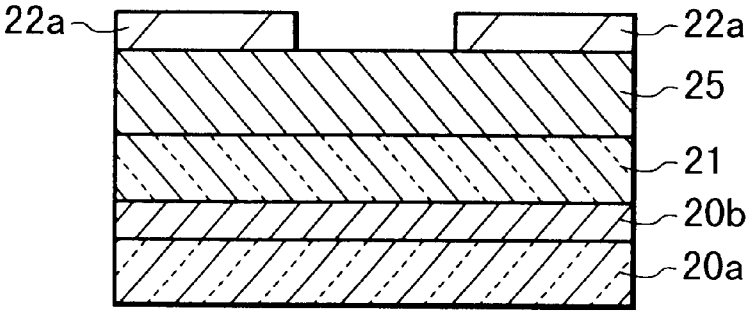

Next, as shown in FIG. 9D, by using the resist pattern 24 as a mask, the antireflection film 22 is anisotropically etched to form an antireflection film 22*a* having a predetermined pattern with a hole 23*a*. Since the resist pattern 24 is formed at a high resolution, the antireflection film 22*a* can be patterned also at a high resolution. The hole 23*a* has a circular plan shape (as viewed from the upper surface) having a diameter of 0.5 μm. Next, as shown in FIG. 9E, the resist pattern 24 is removed to expose the upper surface of the antireflection film 22*a*.

Figure 9F:
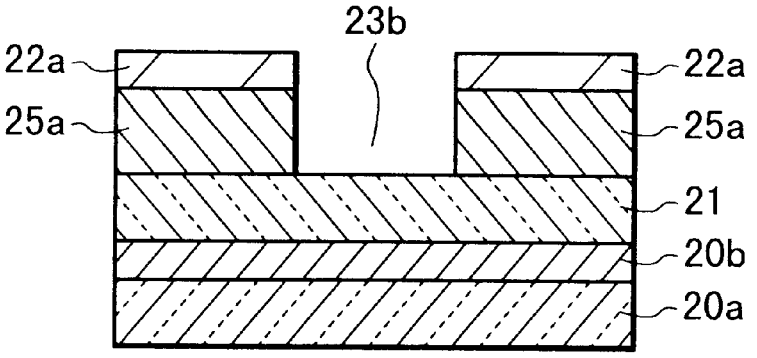

Next, as shown in FIG. 9F, by using the antireflection film 22*a* as a mask, the gate electrode film 25 is anisotropically etched to form a gate electrode 25*a* having a predetermined pattern with a hole 23*b*. Since the antireflection film 22*a* is formed at a high precision, the gate electrode 25*a* can be formed also at a high precision.

The gate electrode film 25 may be etched by using the resist pattern 24 and antireflection film 22*a* as a mask without removing the resist pattern 24 on the antireflection film 22*a*. In this case, the resist pattern 24 is removed after this etching.

Figure 9G:
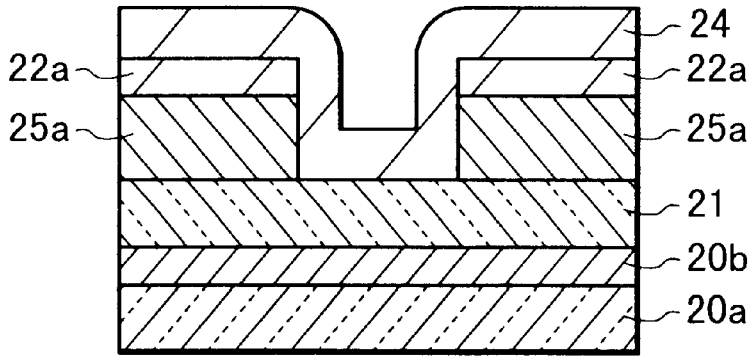

Next, as shown in FIG. 9G, a third sacrificial film (conducting film) 24 of $WSi_x$ is deposited on the whole substrate surface to a thickness of 0.15 μm through low pressure CVD. For example, the low pressure CVD is performed by using source gas of $WF_6$ and $SiH_4$ at a substrate temperature of 400° C. Instead of $WSi_x$, the third sacrificial film may be made of silicide such as $MoSi_x$, $TiSi_x$ and $TaSi_x$ or W, Mo, or Al. Instead of low pressure CVD, plasma CVD or photo assisted CVD may be used.

Figure 9H:
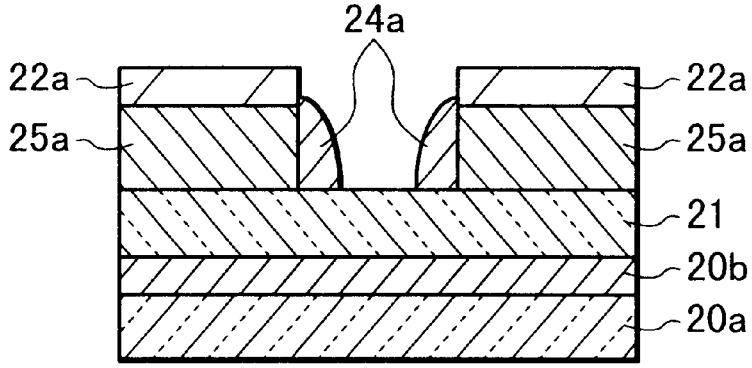

Next, as shown in FIG. 9H, the third sacrificial film 24 is anisotropically dry-etched (etched back) to leave as a side spacer a third sacrificial film 24*a* only on the inner walls of the gate electrode 25*a* and/or antireflection film 22*a*. This etching exposes the upper portion of the inner wall of the antireflection film 22*a* and also the surface of the first sacrificial film 21.

For example, this etching is performed by using a magnetron RIE system under the conditions of an etching gas of $Cl_2$+$O_2$ and a reaction chamber pressure of 150 mTorr. The etching stops at the first sacrificial film.

Figure 9I:
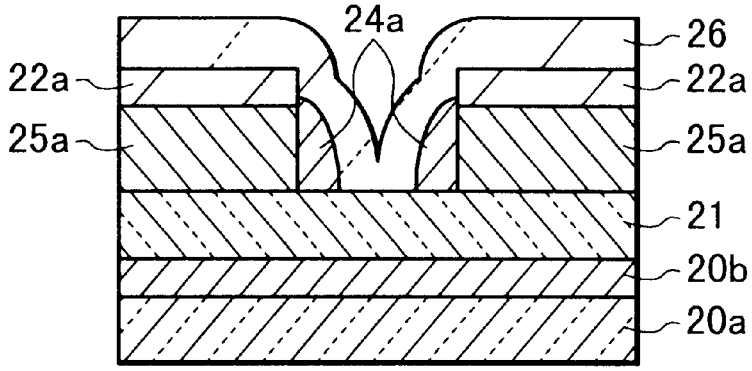

Next, as shown in FIG. 9I, a fourth sacrificial film (insulating film) 26 of $SiO_x$ is isotropically deposited on the whole substrate surface to a thickness of 0.15 μm through atmospheric pressure CVD. The fourth sacrificial film 26 is deposited while inheriting the surface topology of the fourth sacrificial film 26, first sacrificial film 21, side spacer 24*a*, and antireflection film 22*a*. The surface shape of the fourth sacrificial film 26 is defined by a two-stage curve. By utilizing this surface shape as a mold, a two-stage type emitter electrode is manufactured as in the following.

Figure 9J:
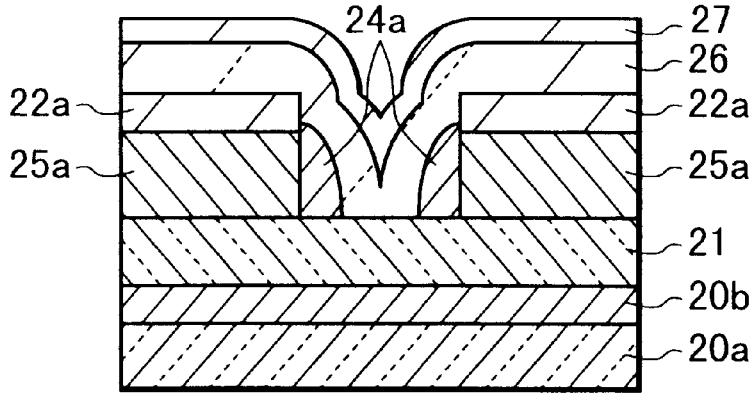

As shown in FIG. 9J, an emitter electrode 27 of, for example, $TiN_x$ (e.g., x=1), is deposited on the fourth sacrificial film 26 to a thickness of about 0.2 μm through reactive sputtering. This reactive sputtering is performed by using a DC sputtering system and Ti as a sputtering target while $N_2$+Ar gas is introduced.

Figure 9K:
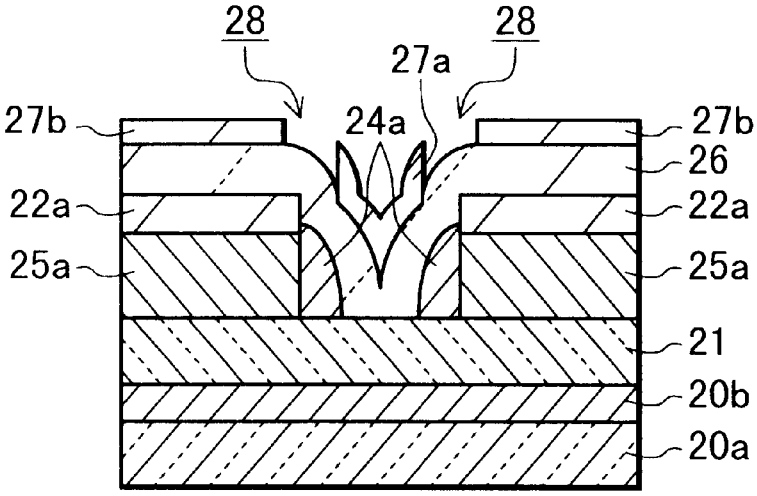

Next, a resist pattern (not shown) is formed on the emitter electrode film 27. As shown in FIG. 9K, by using the resist pattern as a mask, the emitter electrode film 27 is etched by RIE to partially form slit openings 28 through the emitter electrode film 27 which is therefore constituted of an emitter electrode portion 27*b* and an emitter electrode portion 27*a* surrounded by the electrode portion 27*b*. RIE may be performed by using a magnetron RIE system and $Cl_2$ as etching gas at a reaction chamber pressure of 125 mTorr.

Figure 9L:
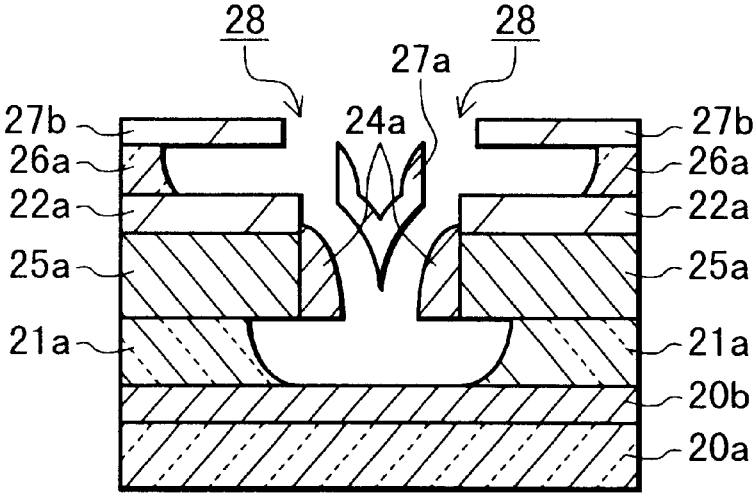

Next, as shown in FIG. 9L, portions of the fourth and first sacrificial films 26 and 21 are isotropically wet-etched and removed through the slit openings 28 to leave a peripheral fourth sacrificial film 26*a* and a first sacrificial film 21*a*. The side spacer 24*a* is left unetched not at all.

This etching exposes the surfaces of the emitter electrode 27*a*, gate electrode 25*a*, side spacer 24*a*, and anode electrode 20*b*. Since the antireflection film 22*a* is electrically connected to the gate electrode 25*a*, the resistance of the gate wiring can be lowered. The antireflection film 22*a* has a function of preventing electromigration and stress migration and improving the reliability.

Each of the gate electrode 25*a*, antireflection film 22*a*, side spacer 24*a* is formed surrounding the gate hole 23*a* and made of two parts (laterally separated regions) as viewed in section. A space between the two parts in the horizontal direction is called a gate diameter. A voltage to be applied to the gate electrodes 25*a*, 22*a*, and 24*a* is determined by the gate diameter.

Figure 10:
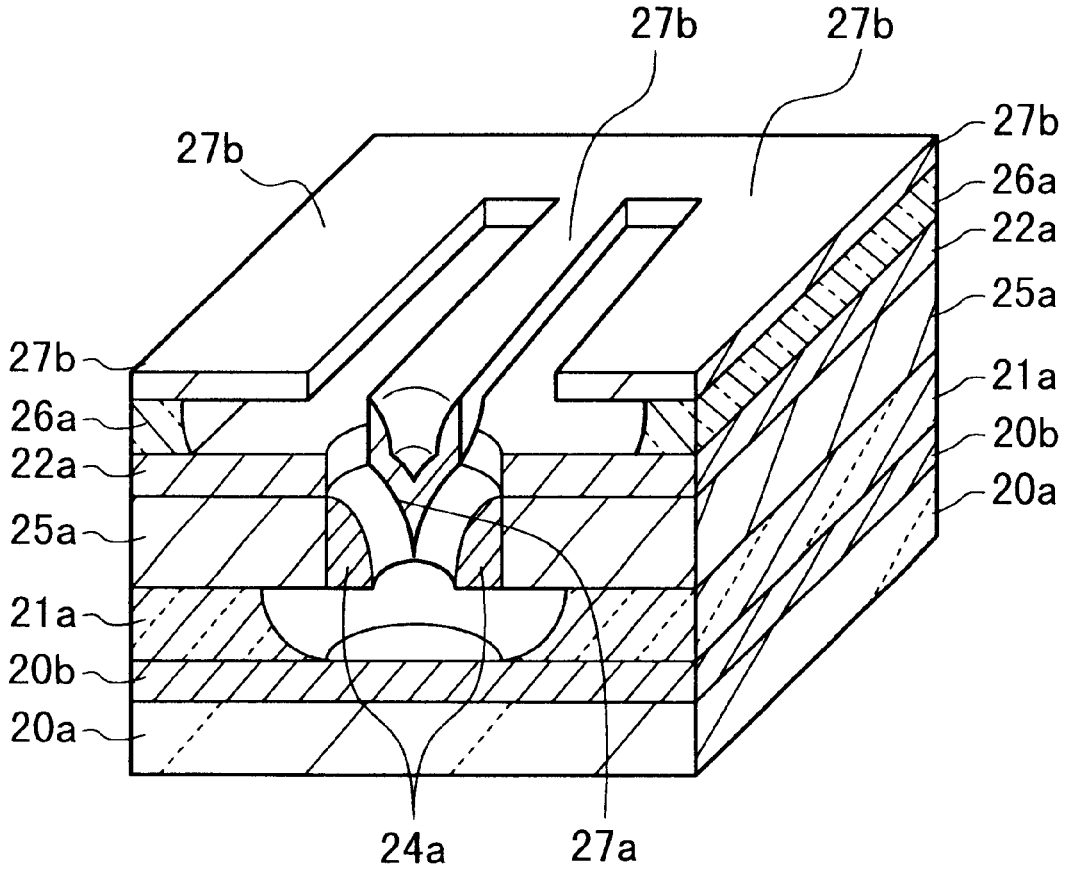
FIG. 10 is a perspective view of the field emission element shown in FIG. 9L.

FIG. 10 is a perspective view of the three-electrode element shown in FIG. 9L. The emitter electrode portion 27*a* is integrally formed with the emitter electrode portion 27*b*. The gate electrode 25*a* has a circular hole (gate hole) near at the tip of the emitter electrode portion 27*a*. The tip of the emitter electrode portion 27*a* has a needle-like sharp edge near at the gate hole of the gate electrode 25*a*.

The three-electrode element has the emitter electrode portion 27*a* as a cathode and the anode electrode 20*b* wherein a positive potential is applied to the gate electrode 25*a* to emit electrons from the emitter electrode portion 27*a* toward the anode electrode 20*b*.

Also in the case of a three-electrode element, the gate diameter of the gate hole can be controlled at a high precision by using the antireflection film 22*a*.

Figure 11A:
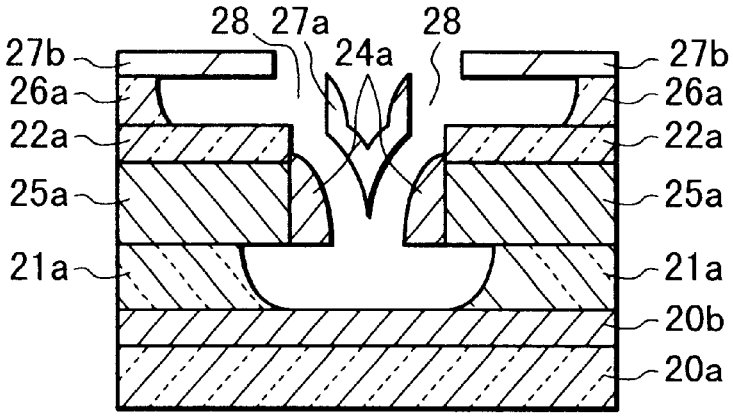
FIGS. 11A to 11D are cross sectional views illustrating the manufacture steps for a field emission element (three-electrode element) according to a modification of the third embodiment of the invention.

FIG. 11A is a cross sectional view showing another example of the three-electrode element. In this three-electrode element shown in FIG. 11A, an antireflection film 22*a* made of $SiN_x$ and having a thickness of 0.02 μm is used, although the three-electrode element shown in FIG. 9L has the antireflection film 22*a* made of $TiN_x$. Since the antireflection film ($SiN_x$) 22*a* is made of insulating material, a dielectric strength between the emitter electrode 27*a* and 27*b* and gate electrode 25*a* can be improved. The other structures of the three-electrode element shown in FIG. 11A are same as those of the element shown in FIG. 9L.

Figure 11B:
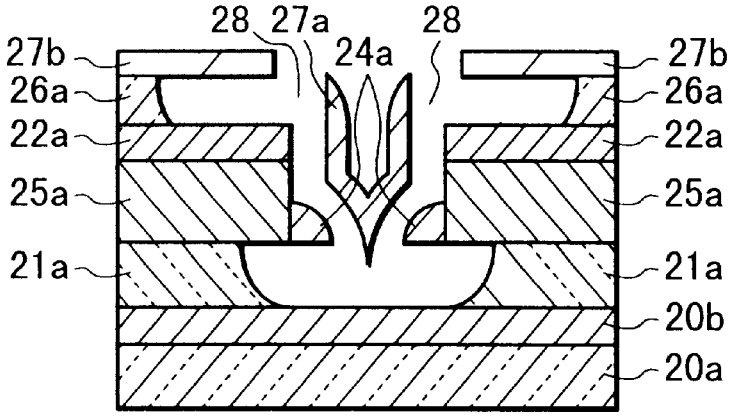

FIG. 11B is a cross sectional view showing another example of the three-electrode element. In the three-electrode element shown in FIG. 11A, the antireflection film 22*a* is made of $SiN_x$, whereas in the three-electrode element shown in FIG. 11B, an antireflection film 22*a* is made of Si and has a thickness of 0.008 μm. At the etching process shown in FIG. 9H, over-etching is performed to form a recess having a depth of 0.1 μm in the first sacrificial film 21. Therefore, the tip of the emitter electrode 27*a* can be lowered relative to the gate electrode 25*a*. The other structures of the three-electrode element shown in FIG. 11B are same as those of the element shown in FIG. 11A.

Figure 11C:
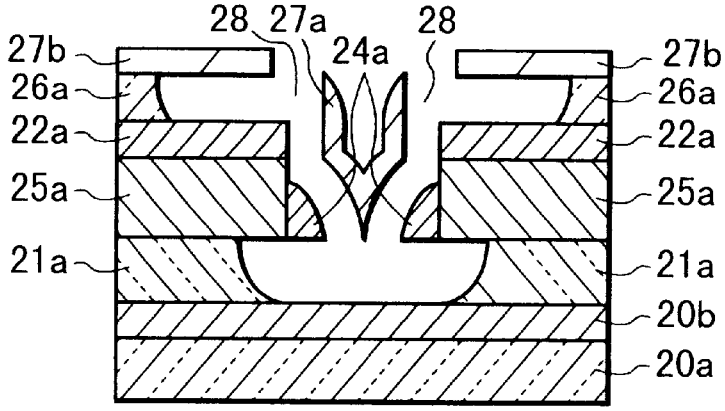

FIG. 11C is a cross sectional view showing another example of the three-electrode element. In the three-electrode element shown in FIG. 11B, the antireflection film 22*a* is made of Si, whereas in the three-electrode element shown in FIG. 11C, an antireflection film 22*a* is made of $TiN_x$. Similar to the case of FIG. 11B, at the etching process shown in FIG. 9H, over-etching is performed to form a recess having a depth of 0.1 μm in the first sacrificial film 21. Therefore, the tip of the emitter electrode 27*a* can be lowered relative to the gate electrode 25*a*. The other structures of the three-electrode element shown in FIG. 11C are same as those of the element shown in FIG. 11B. The etching is performed by using a magnetron RIE system under the conditions of a flow rate ratio of $CHF_3/CO_2/Ar$=

60/10/30 (sccm), a pressure of 50 mTorr, a magnetic field intensity of 30 G, an RF power of 700 W and cooling He at 8 Torr.

Figure 11D:
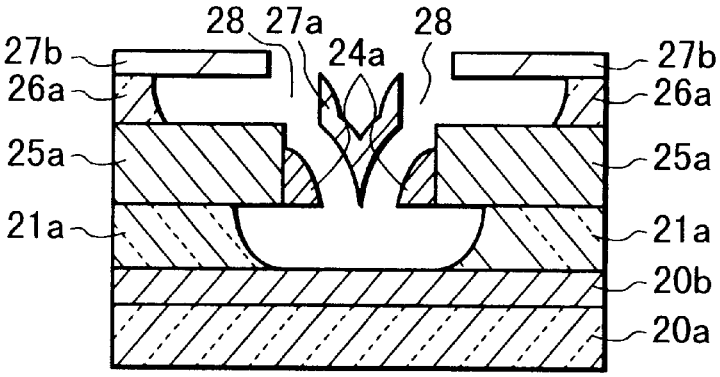

FIG. 11D is a cross sectional view showing another example of the three-electrode element. In the three-electrode element shown in FIG. 11C, the antireflection film 22*a* is maintained left to the last process. In the three-electrode element shown in FIG. 11D, similar to the processes in FIGS. 8A and 8B, after the element in the state shown in FIG. 9F is manufactured, the antireflection film 22*a* is removed and the third sacrificial film 24 is deposited. The antireflection film 22*a* does not exist in the final three-electrode element shown in FIG. 11D. In addition, similar to the case of FIG. 11C, at the etching process shown in FIG. 9H, the first sacrificial film 21 is over-etched to form a recess having a depth of 0.1 $\mu$m therein. The other structures of the three-electrode element shown in FIG. 11D are same as those of the element shown in FIG. 11C. The etching is performed by using a magnetron RIE system under the conditions of a flow rate ratio of $CHF_3/CO_2/Ar$= 60/10/30 (sccm), a pressure of 50 mTorr, a magnetic field intensity of 30 G, an RF power of 700 W and cooling He at 8 Torr.

According to the first to third embodiments, by forming an antireflection film on the gate electrode (or second lamination film 10*c* (FIG. 1B)), a resolution of photolithography and etching can be improved.

Figure 12:
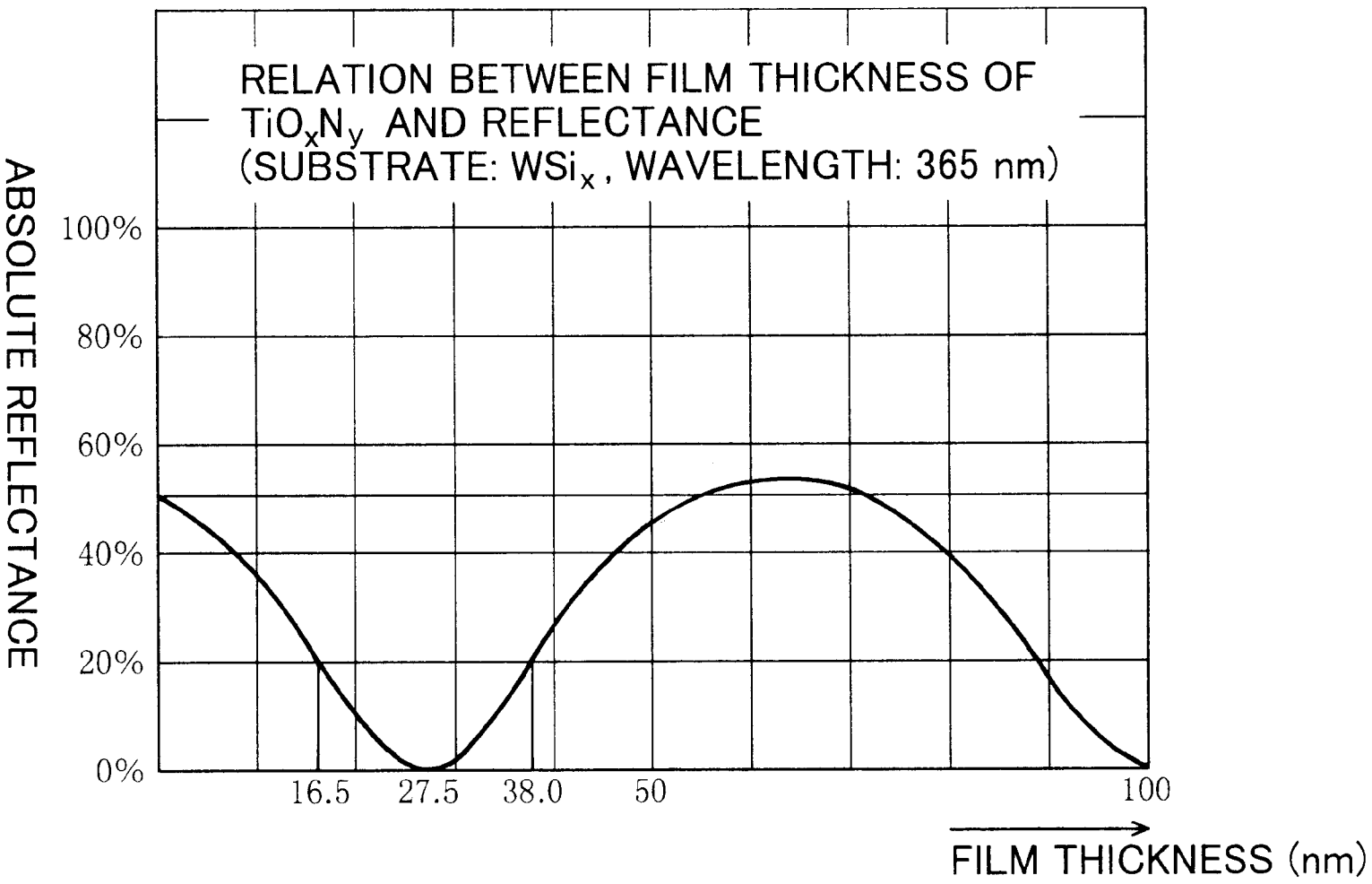
FIG. 12 is a graph showing a relation between a reflectance and a film thickness of an antireflection film ($Ti_xON_y$) formed on a substrate ($WSi_x$).
Figure 13:
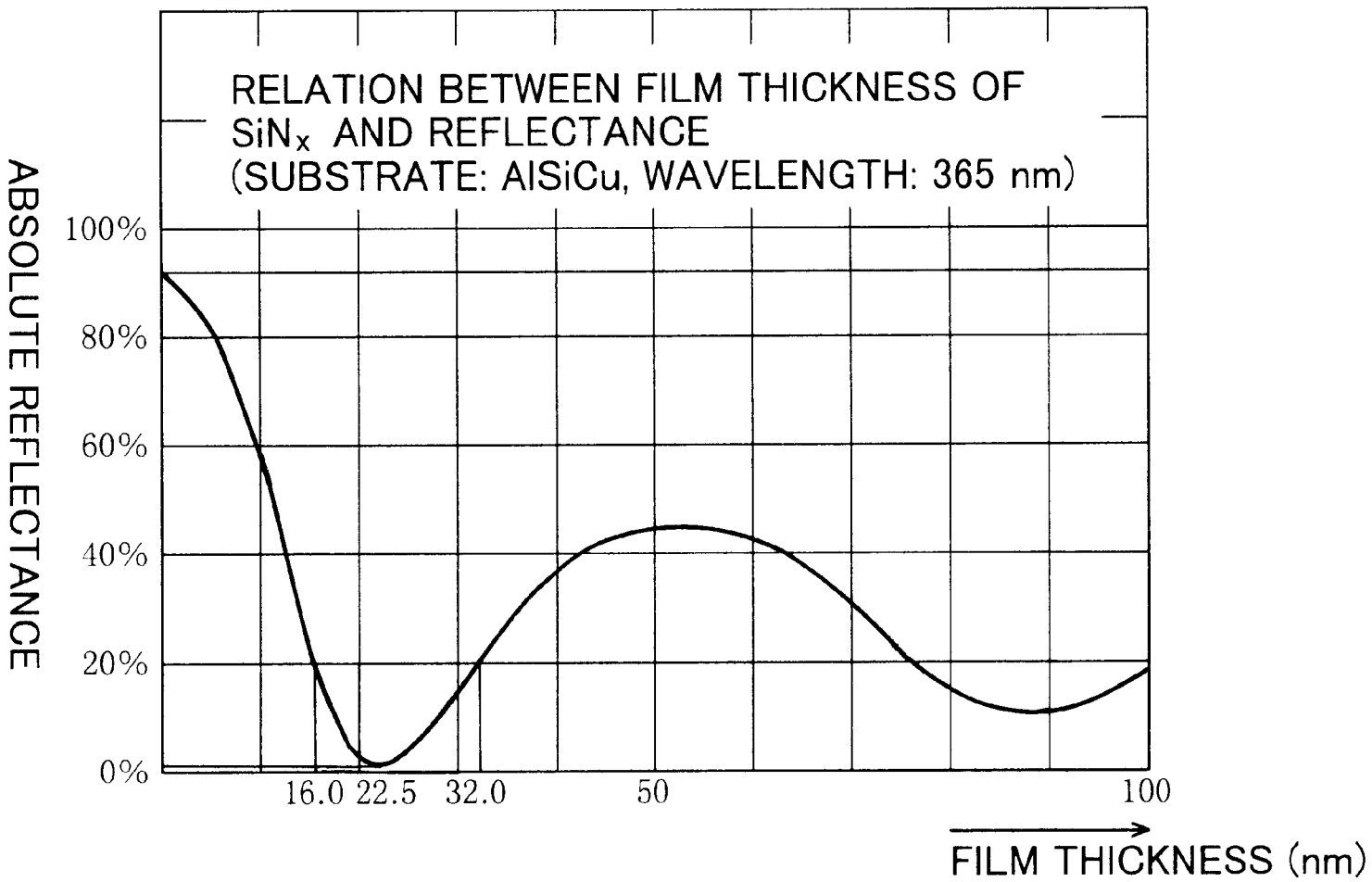
FIG. 13 is a graph showing a relation between a reflectance and a film thickness of an antireflection film ($SiN_x$) formed on a substrate ($AlSi_xCu_y$).
Figure 14:
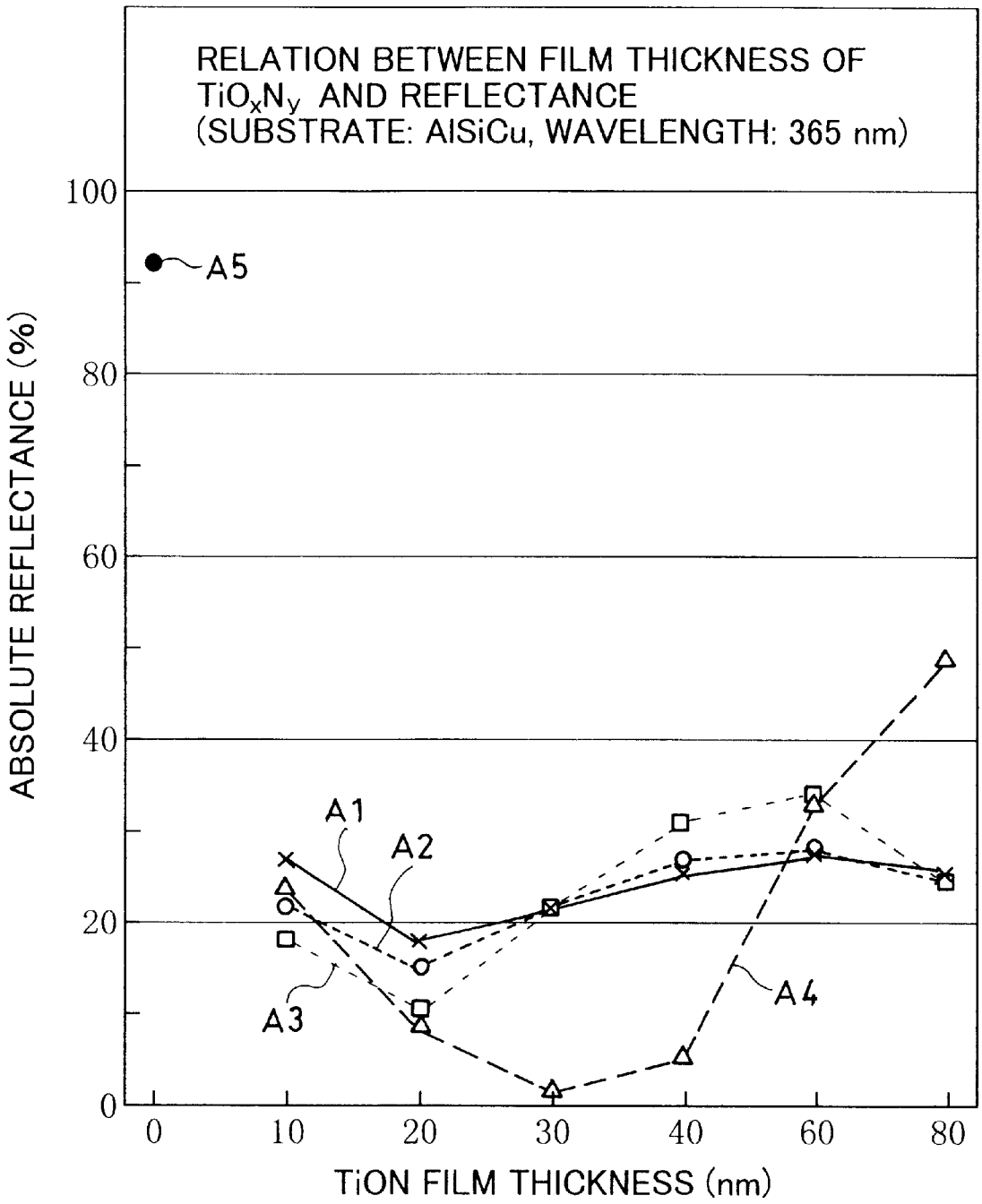
FIG. 14 is a graph showing a relation between a reflectance and a film thickness of an antireflection film ($TiO_xN_y$) formed on a substrate ($AlSi_xCu_y$).

A reflectance of an antireflection film depends on its film thickness. Measured results of a relation between the thickness of an antireflection film and a reflectance are shown in the graphs of FIGS. 12 to 14. An antireflection film was deposited on a substrate through sputtering and a relation between the thickness of an antireflection film and an apparent reflectance was measured. The apparent reflectance was converted into an absolute reflectance by measuring refractive indices (n, k) of a substrate and an antireflection film.

FIG. 12 is a graph showing a relation between the thickness of an antireflection film ($TiO_xN_y$) and an absolute refractive index. This graph shows the measurement results of a reflectance when an antireflection film ($TiO_xN_y$) is formed on a substrate ($WSi_x$) and i-line (365 nm) light is applied. The antireflection film ($TiO_xN_y$) was formed through sputtering at a gas flow rate of $O_2/N_2$=25/75.

The reflectance showed periodically changing oscillation characteristics relative to a film thickness. This results from interference between incidence light and light reflected from the substrate. It is most preferable to set the film thickness to 27.5 nm at which the reflectance takes a minimum value. It is preferable to set the reflectance to 20% or smaller. In order to set the reflectance to this value, the film thickness is set in a range from 16.5 nm to 38.0 nm.

It is therefore preferable to deposit a gate electrode ($WSi_x$) on an antireflection film ($TiO_xN_y$) having a thickness from 16.5 to 38.0 nm, because the reflectance can be set to 20% or lower.

In addition to $WSi_x$, the gate electrode may be made of polysilicon or amorphous silicon. In addition to $TiO_xN_y$, the antireflection film may be made of $TiN_x$ or $TiO_x$.

FIG. 13 is a graph showing a relation between the thickness of an antireflection film ($SiN_x$) and an absolute refractive index. This graph shows the measurement results of a reflectance when an antireflection film ($SiN_x$) is formed on a substrate ($AlSi_xCu_y$) and i-line (365 nm) light is applied. The antireflection film ($SiN_x$) was formed through sputtering at a gas flow rate of $Ar/N_2$=85/15.

The reflectance showed oscillation characteristics relative to a film thickness, the amplitude of oscillation gradually increasing and decreasing. It is most preferable to set the film thickness to 22.5 nm at which the reflectance takes a minimum value. It is preferable to set the reflectance to 20% or smaller. In order to set the reflectance to this value, it can be understood that the film thickness is set in a range from 16.0 nm to 32.0 nm.

It is therefore preferable to deposit a gate electrode ($AlSi_xCu_y$) on an antireflection film ($SiN_x$) having a thickness from 16.0 to 32.0 nm, because the reflectance can be set to 20% or lower.

In addition to $AlSi_xCu_y$, the gate electrode may be made of Al or Al alloy such as $AlCu_x$ and $AlSi_x$. In addition to $SiN_x$, the antireflection film may be made of $WSi_x$, polysilicon, $SiO_xN_y$, $SiO_x$, $AlO_x$, $AlN_x$, or $AlO_xN_y$.

The comparison ratio of $SiO_xN_y$ or $SiN_x$ (where x and y are positive real numbers) for forming an antireflection film is preferably Si:O:N=1:0–0.31:0.5–1. For example, Si:O:N= 1.0:0.11:0.76.

FIG. 14 is a graph showing a relation between the thickness of an antireflection film ($TiO_xN_y$) and an absolute refractive index. This graph shows the measurement results of a reflectance when an antireflection film ($TiO_xN_y$) is formed on a substrate ($AlSi_xCu_y$) and i-line (365 nm) light is applied.

A characteristic curve Al shows a reflectance of the antireflection film ($TiN_x$) deposited through sputtering at a gas composition ratio of $O_2/N_2$=0/100. Characteristic curves A2, A3 and A4 show reflectance of the antireflection films ($TiO_xN_y$) deposited through sputtering at gas composition ratios of $O_2/N_2$=10/90, 20/80 and 30/70, respectively. A characteristic point A5 shows a reflectance of the substrate ($AlSi_xCu_y$) without the antireflection film.

As indicated by the characteristic point A5, the reflectance at the surface of the substrate ($AlSi_xCu_y$) without the antireflection film is about 90%. As shown by the characteristic curves A1 to A4, as the antireflection film ($TiO_xN_y$) is formed on the substrate ($AlSi_xCu_y$), the reflectance of the antireflection film ($TiO_xN_y$) lowers. In order to set the reflectance to 20% or lower, the thickness of the antireflection film ($TiO_xN_y$) is set in a range from 10 to 50 nm.

It is preferable to form an antireflection film ($TiO_xN_y$) having a thickness of 10 to 50 nm on a gate electrode ($AlSi_xCu_y$), because the reflectance can be set to 20% or lower. In addition to $AlSi_xCu_y$, the gate electrode may be made of Al or Al alloy such as $AlCu_y$ and $AlSi_x$. The antireflection film may be made of $TiN_x$, $TiO_xN_y$ or $TiO_x$.

The comparison ratio of $TiO_xN_y$ or $TiO_x$ (where x and y are positive real numbers) for forming an antireflection film is preferably Ti:O:N=1:2.051–1/60:0–0.47. For example, Ti:O:N=1.0:1.83:0.22.

Figure 15:
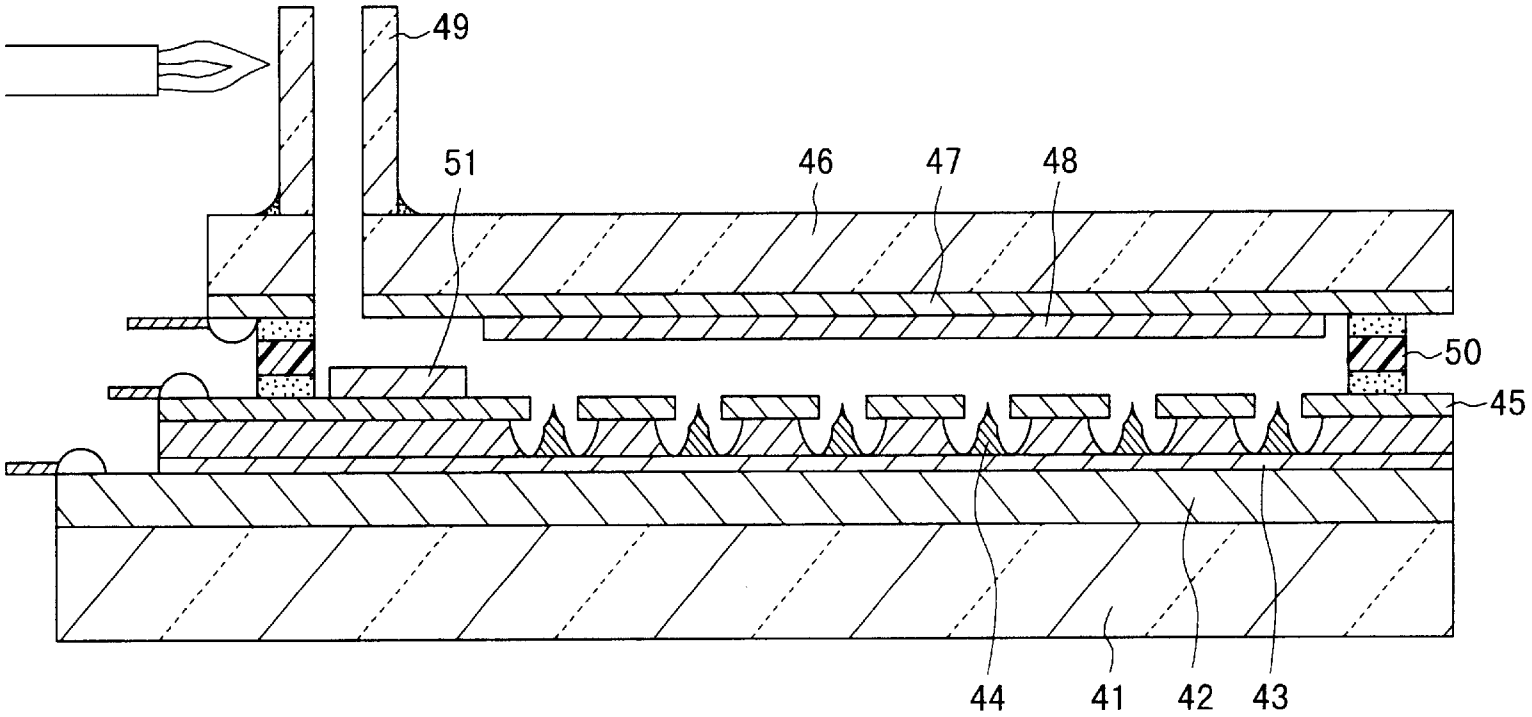
FIG. 15 is a cross sectional view of a flat panel display using field emission elements.

FIG. 15 is a cross sectional view of a flat panel display using field emission elements.

Each field emission element shown in FIG. 15 is a two-electrode element formed by the manufacture method of the second embodiment. Formed on a support substrate 41 made of insulating material, are a wiring layer 62 made of Al, Cu, or the like and a resistor layer 43 made of polysilicon or the like. On the resistor layer 43, a number of emitter electrodes 44 having a small apex angle and radius of curvature of the emitter tip are disposed to form a field emitter array (FEA). Each gate electrode 45 has an opening (gate hole) near at the tip of each emitter electrode 44, and although not explicitly shown a voltage can be applied independently to each gate electrode. A plurality of emitter electrodes 44 can also be independently applied with a voltage.

Facing an electron source including the emitter electrode 44 and gate electrode 45, an opposing substrate is disposed including a transparent substrate 46 made of glass, quartz, or the like. The opposing substrate has a transparent electrode (anode electrode) 47 made of ITO or the like disposed under the transparent electrode 46 and a fluorescent member 48 disposed under the transparent electrode 47.

The electron source and opposing substrate are joined together via a spacer 50 made of a glass substrate and coated with adhesive, with the distance between the transparent electrode 47 and emitter electrode 44 being maintained about 0.1 to 5 mm. The adhesive may be low melting point glass.

Instead of the spacer 50 of a glass substrate, a spacer 50 made of adhesive such as epoxy resin with glass beads being dispersed therein may be used.

A getter member 51 is made of Ti, Ta, Zr, Al, Mg, or the like. The getter member 51 prevents emitted gas from attaching again to the surface of the emitter electrode 44.

An air exhaust pipe 49 is coupled to the opposing substrate. By using this air exhaust pipe 49, the inside of the flat display panel is evacuated to about $10^{-5}$ to $10^{-9}$ Torr, and then the air exhaust pipe 49 is sealed by using a burner or the like. Thereafter, the anode electrode (transparent electrode) 47, emitter electrode 44, gate electrode 45 are wired to complete the flat panel display.

The anode electrode (transparent electrode) 47 is always maintained at a positive potential. A pixel is two-dimensionally selected by the emitter wiring and gate wiring. Namely, a field emission element disposed at a cross point between the emitter wiring and gate wiring is selected.

The emitter electrode is applied with a negative potential, and the gate electrode is applied with a positive potential. Electrons are emitted from the emitter electrode toward the anode electrode. When electrons collide with the fluorescent member 48, a portion of the fluorescent member 48 collided with electrons emits light.

According to the first to third embodiments, by forming an antireflection film on a resist film, the resist film can be patterned at a high resolution through exposure and development. By using the patterned resist film as a mask, the antireflection film is etched, and by using the patterned antireflection film as a mask, the gate electrode (or second lamination film 10*c* (FIG. 1B), this citation being applicable to the following description) is etched. The shape and size of a sacrificial film deposited thereafter can be controlled at a high precision, the sacrificial film being used as a mold for the emitter electrode. Since the emitter electrode is deposited on this mold, the shape and size of the emitter electrode can also be controlled at a high precision.

Furthermore, the gate electrode can be formed to have a predetermined shape at a high precision. A variation of gate hole diameters of a flat display panel having a number of field emission elements can be reduced so that the electric characteristics of field emission elements can be made uniform and so the luminance of pixels of the display can be made uniform.

The gate electrode, second lamination film and emitter electrode may be made of: semiconductor such as polysilicon and amorphous silicon; silicide compound such as $WSi_x$ (e.g, x=27), $TiSi_x$ (e.g., x=2.6) and $MoSi_x$ (e.g., x=2.4); or metal such as Al, Cu, W, Mo, Ni, and $TiN_x$ e.g., x=1).

The present invention has been described in connection with the preferred embodiments. The invention is not limited only to the above embodiments. It is apparent that various modifications, improvements, combinations, and the like can be made by those skilled in the art.

What is claimed is:

1. A field emission element comprising:

a gate electrode having a first opening;

an antireflection film formed on said gate electrode, said antireflection film having a second opening on said first opening and a refractive index smaller than a refractive index of said gate electrode;

an insulating film formed on said antireflection film, said insulating film having a third opening on said second opening; and an emitter electrode formed on said insulating film, wherein said emitter electrode includes a peripheral portion supported on said insulating film and a projecting portion projecting from the peripheral portion into the first to third openings, and the projecting portion includes a base portion being continuous with the peripheral portion and having at least an outer surface with a radius of curvature and a tip portion having a sharp cusp and an outer surface with a radius of curvature smaller than the radius of curvature of the outer surface of the base portion.

2. A field emission element according to claim 1, wherein said antireflection film is made of $SiN_x$.

3. A field emission element according to claim 1, wherein said gate electrode includes a first gate electrode made of polysilicon and a second gate electrode made of $WSi_x$ and formed on the first gate electrode.

4. A field emission element according to claim 1, wherein said emitter electrode includes at least one of $TiN_x$, Mo, Cr, Ti, and W.

5. A field emission element according to claim 1, further comprising a side spacer formed at least on an inner wall of the first opening of said gate electrode, said side spacer having an inner surface having a radius of curvature generally equal to the radius of curvature of the outer surface of the tip portion.

6. A field emission element according to claim 1, further comprising a support substrate formed on a surface of said emitter electrode on side opposite to the tip portion of the base portion, said support substrate supporting said emitter electrode.

7. A field emission element according to claim 1, wherein the projecting portion includes an intermediate portion being continuous with the peripheral portion and having a generally cylindrical shape and the tip portion.

8. A field emission element comprising:

a starting substrate;

an anode electrode film formed on said starting substrate;

a sacrificial film formed on said anode electrode film and having a first opening;

a gate electrode formed on said first sacrificial film and having a second opening;

an antireflection film formed on said gate electrode and having a third opening;

an insulating film formed on said antireflection film and having a fourth opening; and an emitter electrode formed on said insulating film and having a fifth opening, wherein said emitter electrode includes a peripheral portion supported on said insulating film and a projecting portion and projecting into the second to fourth openings, and the projecting portion includes a base portion being continuous with the peripheral portion and having at least an outer surface with a radius of curvature and a tip portion having a sharp cusp and an outer surface with a radius of curvature smaller than the radius of curvature of the outer surface the base portion.

9. A field emission element according to claim 8, wherein said antireflection film comprizes at least one of $TiN_x$, $TiO_xN_y$ and $TiN_x$.

10. A field emission element according to claim 8, wherein said antireflection film is made of $TiO_xN_y$ or $TiN_x$ and a surface of said antireflection film is etched to form uneven surface to lower a reflection.

11. A field emission element according to claim 8, wherein said anode electrode is made of $AlSi_xCu_y$.

12. A field emission element according to claim 8, further comprizing a side spacer formed on an inner wall of the second opening of said gate electrode, said side spacer having a radius of curvature generally equal to the radius of curvature of the outer surface of the tip portion.

13. A field emission element according to claim 8, wherein said emitter electrode has two slits between the peripheral portion and the projecting portion.

14. A field emission element according to claim 8, wherein said antireflection film is made of a thin silicon film.

15. A field emission element according to claim 8, wherein the sharp cusp of the tip portion of said emitter electrode extends into the first opening of said first sacrificial film.

16. A flat display panel comprising:

a support substrate;

a transparent substrate facing said support substrate through a gap, said transparent substrate including a transparent electrode and a fluorescent layer; and an emitter structure on the support substrate, and including:

a conductive wiring layer;

a resistor layer formed on the wiring layer;

an insulating film including an antireflection film formed on the resistor layer and having a plurality of openings;

a plurality of gate electrodes formed on the insulating film; and a plurality of emitter electrodes formed on the resistor layer in the plurality of openings, each emitter electrode includes a projecting portion directed toward said transparent substrate, the projecting portion including a base portion having at least an outer surface with a radius of curvature and a tip portion having a sharp cusp and an outer surface with a radius of curvature smaller than the radius of curvature of the outer surface of the base portion.

* * * * *